US010968613B2

(12) United States Patent
Stein

(10) Patent No.: US 10,968,613 B2
(45) Date of Patent: Apr. 6, 2021

(54) SANITARY OUTLET PIECE, SANITARY FITTING AND USE OF AN OUTLET PIECE

(71) Applicant: Neoperl GmbH, Mullheim (DE)

(72) Inventor: Alexander Stein, Ihringen (DE)

(73) Assignee: Neoperl GmbH, Müllheim (DE)

( * ) Notice: Subject to any disclaimer, the term of this patent is extended or adjusted under 35 U.S.C. 154(b) by 46 days.

(21) Appl. No.: 16/072,642

(22) PCT Filed: Jan. 26, 2017

(86) PCT No.: PCT/EP2017/000087

§ 371 (c)(1),
(2) Date: Jul. 25, 2018

(87) PCT Pub. No.: WO2017/129363

PCT Pub. Date: Aug. 3, 2017

(65) Prior Publication Data

US 2019/0032309 A1 Jan. 31, 2019

(30) Foreign Application Priority Data

Jan. 27, 2016 (DE) ..... 202016000472.8

(51) Int. Cl.
*E03C 1/04* (2006.01)

(52) U.S. Cl.
CPC ..... *E03C 1/0404* (2013.01); *E03C 2201/45* (2013.01); *Y10T 137/9464* (2015.04)

(58) Field of Classification Search
CPC ..... E03C 1/0404; Y10T 137/9464
See application file for complete search history.

(56) References Cited

U.S. PATENT DOCUMENTS

| | | | | |
|---|---|---|---|---|
| 5,871,029 | A * | 2/1999 | Peteri | E03C 1/0404 137/615 |
| 8,763,175 | B2 * | 7/2014 | Li | E03C 1/0402 137/359 |
| 9,206,917 | B2 * | 12/2015 | Lin | F16K 19/006 |
| 2003/0010721 | A1 | 1/2003 | Aldred et al. | |
| 2013/0248019 | A1 * | 9/2013 | Frick | E03C 1/0401 137/468 |
| 2014/0250590 | A1 * | 9/2014 | Keiter | E03C 1/0404 4/678 |

FOREIGN PATENT DOCUMENTS

| | | |
|---|---|---|
| DE | 202006004399 | 7/2007 |
| EP | 0872601 | 10/1998 |
| WO | 2007113663 | 10/2007 |

* cited by examiner

*Primary Examiner* — Kevin R Barss
(74) *Attorney, Agent, or Firm* — Volpe Koenig

(57) ABSTRACT

For a sanitary outlet piece (1), it is proposed to have at least two hose connection points (3, 4, 5), which are laterally offset to each other, formed on an inlet side (6) and are guided in the sanitary outlet piece (1) separate from one another from the inlet side (2) to an outlet side (6) of the sanitary outlet piece (1).

31 Claims, 15 Drawing Sheets

SANITARY OUTLET PIECE, SANITARY FITTING AND USE OF AN OUTLET PIECE

BACKGROUND

The invention relates to a sanitary outlet piece with an inlet side and an outlet side and with more than two, preferably at least three, hose connection points which are formed in a manner spaced apart from one another on the inlet side and are each guided to the outlet side. The invention is also concerned with a sanitary fitting which has a sanitary outlet piece of the type mentioned at the beginning. Furthermore, the present invention is also concerned with the use of an outlet piece mentioned at the beginning in a sanitary fitting of the aforementioned type.

Sanitary outlet pieces are known and are used in fitting outlets, i.e., for example, in the outflow-side ends of fittings, in order to provide a desired jet shape and/or a desired flow rate.

It is customary in this connection for the sanitary outlet piece to be supplied with an available amount of water which is subsequently shaped in the sanitary outlet piece to form the desired jet pattern.

DE 20 2006 004 399 U1 already discloses a fluid fitting with a sanitary outlet piece of the type mentioned at the beginning, which fluid fitting is determined as a multifunction fitting for dispensing a plurality of fluids. In order to transmit information about the property and/or the state of the removed fluid to the user, the previously known fluid fitting has a coloration device for coloring the dispensed fluid. The sanitary outlet piece used in the previously known fluid fitting has an inlet side and an outlet side and also more than two, preferably at least three, hose connection points which are formed in a manner spaced apart from one another on the inlet side and are each guided to the outlet side.

US 2003/0010721 A1 already discloses a sanitary outlet fitting, in which the water flowing through is removable at a water outlet. An adjustable and closable mixing device is integrated in the previously known outlet fitting. The water is guided by said mixing device to the water outlet via a hose line running in the interior of the outlet fitting.

EP 0872601 A1 already discloses a multifunction fitting which is intended for the optional removal of warm water, hot water and enriched water from one and the same water outlet. In the previously known outlet fitting, various lines are guided separately from one another for this purpose, the outflow-side line openings of which are provided in the water outlet of the sanitary outlet fitting.

WO 2007/113663 A2 discloses a comparable multifunction fitting, in which, by contrast, the line openings of the hose lines guided in the outlet fitting open in a common water outlet.

SUMMARY

The invention is based on the object of extending the application possibilities for sanitary outlet pieces.

The achievement according to the invention of this object resides, in the case of the outlet piece of the type mentioned at the beginning, in including one or more features of the invention as discussed below.

The sanitary outlet piece according to the invention has an inlet side and an outlet side and more than two, preferably at least three, hose connection points which are formed in a manner spaced apart from one another on an inlet side and are each guided to the outlet side. The invention therefore makes it possible to be able to supply the sanitary outlet piece with different prepared volumes of water separately from one another, said volumes of water remaining neatly separated even in the outlet. It is provided here according to the invention that a holding plate having at least three recesses corresponding to the hose connection points is formed, into which in each case one hose is insertable by means of an insertion movement oriented transversely with respect to the longitudinal direction of the respective hose. In the case of the outlet piece according to the invention, a plug-in system is therefore provided, in which the hoses can be connected to the hose connection point without being screwed in. An undesired twisting of the hoses is therefore avoidable.

Three or more hose connection points designed as three hose connection points which are spaced apart from one another are preferably formed here on the inlet side. At least three different volumes of water, for example hot water, cold water and mixed water, can therefore be supplied and conducted through.

The spaced-apart design of the hose connection points has the advantage that thermal insulation of the connected hoses from one another is achievable by means of the air section located in-between. The effect which can thereby be achieved is that, for example, the hot water or the cold water is/are not inadvertently brought by the mixed water to an intermediate temperature. By the design of hose connection points, thermal decoupling of the volumes of water conducted therethrough can therefore also be achieved by a sanitary fitting by the hoses being guided at the hose connection points to the sanitary fitting in a manner spatially spaced apart.

In a refinement according to the invention, it can be provided that at least one housing edge is arranged between the inlet side and the outlet side. The inlet side can therefore be arranged separately from the outlet side. The outlet side is therefore completely usable for the water/volumes of water flowing out. In one exemplary embodiment, the outlet side and the inlet side can thus have different orientations, wherein a housing edge can then suffice for the separation. For example, the inlet side and the outlet side can also be oriented parallel to each other, in particular with opposite orientations. In this case, at least two housing edges are preferably formed between the inlet side and the outlet side.

The housing edge(s) can be formed here on a basic body in a rectilinear or curved manner, in particular in an annularly encircling manner.

Alternatively or additionally, it can be provided that the inlet side and the outlet side are arranged spaced apart from each other.

It can also be provided that the inlet side and the outlet side enclose an angle, for example by formation of a housing edge lying between the inlet side and the outlet side.

In a further refinement according to the invention it can be provided that the hose connection points on the one hand and the outlet side on the other hand are formed at mutually opposite ends of the outlet piece. It is of advantage here that the sanitary outlet piece can be arranged in a tubular receptacle, for example a fitting outlet, wherein a liquid flow can be conducted through the tubular receptacle without a reversal in direction in the sanitary outlet piece.

Alternatively or additionally, in one refinement, individual or all of the hose connection points can be formed on a lateral outer wall, for example the outer wall already mentioned. The inlet side is therefore also at least partially formed laterally and/or directly adjacent to the outlet side. It is of advantage here that alternative or additional installation forms can be provided. The inlet side and the outlet side can be separated here by a housing edge and enclose an angle with each other.

When the inlet side and the outlet side are arranged with respect to one another in such a manner that they enclose an angle with each other, the sanitary outlet piece can therefore be formed as an angle piece. Water ducts which will be described in more detail below can therefore be guided at an angle within the outlet piece. This permits the installation into a sanitary fitting in which the outlet direction is oriented at an angle in relation to a direction in which a fitting outlet runs.

It can be provided here that an encircling outer wall is formed between the ends. It is of advantage here for the sanitary outlet piece to be able to be placed against an inner wall of the tubular receptacle. Secure support can therefore be achieved. The outer wall can generally be of prism-shaped design, that is to say, substantially identical base and top surfaces connect to each other. This permits the insertion into a tubular receptacle, the contour of which is adapted to the contour of the outer wall. It is preferably provided here that the outer wall is of substantially cylindrical design. This permits particularly simple insertion into the receptacle.

In one refinement of the invention, it can be provided that the hose connection points are guided to the outlet side separately from one another. This permits a flow-free conducting through of the various volumes of water as far as the outlet side.

In one refinement of the invention, it can be provided that at least one hose connection point is guided to the outlet side in a valve- and/or junction-free manner. Mixing of water supplied in the hose connection point with further volumes of water can therefore be avoided. All of the hose connection points are preferably guided to the outlet side in a valve- and/or junction-free manner.

In one refinement of the invention, it can be provided that water outlets which are separate from one another are formed on the outlet side and are each connected to a hose connection point. It is of advantage here that a mixing-free transfer of the conducted-through volumes of water to a downstream component, for example to a jet regulator and/or jet former, is made possible.

In one refinement of the invention, it can be provided that at least one hose connection point has a different, in particular larger or smaller, opening diameter than the remaining hose connection points. At least one hose connection point which permits a high flow rate is therefore provided. This can be, for example, a hose connection point for mixed water. By contrast, the remaining hose connection points are chargeable with a lower throughput, and therefore a lower amount of water is removable via the remaining hose connection points.

In one refinement of the invention, it can be provided that an internal thread into which a connecting piece is screwable or is screwed is formed on at least one hose connection point. Conventional or standardized hoses are therefore connectable in a simple manner. A corresponding internal thread is preferably formed at each hose connection point. It can also be provided that at least one connecting piece is insertable or inserted, or that at least one connecting piece is fixable or fixed—via a bayonet connection.

Alternatively, individual or all of the connecting pieces can be connected, for example as fittings, in an integrally bonded manner to a basic body of the outlet piece and/or can be formed integrally thereon. The hose can be plugged on and preferably secured against slipping off.

It can be provided here that a holding stop is formed on an outlet element, which is fitted on the basic body on the outflow side, for example the outlet element already mentioned, preferably on a supporting edge, for example the supporting edge already mentioned, at which the basic body is pressable against the holding plate, which is supported from the outside. The holding plate can therefore be fixed in a simple manner, for example in a fitting outlet.

Alternatively or additionally, it can be provided that the basic body is pressable with a screw sleeve, which is preferably designed as a mouthpiece, against the holding plate, which is supported from the outside. It is favorable if the screw sleeve is designed as a mouthpiece. The basic body can therefore be fastened to a fitting outlet with a standard mating thread. The basic body is preferably pressable or pressed via a holding stop, for example the supporting edge already mentioned, against an outlet element, which is fitted to the basic body on the outflow side, for example the outlet element already mentioned. Fixing with a mouthpiece can therefore be achieved.

Alternatively or additionally, it can be provided that the screw sleeve is screwable or screwed to a fitting outlet, for example receiving the basic body. This permits simple assembly with standard components.

In one refinement of the invention, it can be provided that a hose connection point is guided via a distribution chamber to a plurality of outlet openings. It is of advantage here that an inflowing amount of water which flows in via the hose connection point is distributable to a multiplicity of outlet openings such that a desired, for example homogeneous, outlet pattern can be achieved in a simple manner. The distribution chamber is preferably designed here curved in a C-shaped manner in order, for example, to load an annular or C-shaped arrangement of outlet openings. The distribution chamber can also be designed in a manner running annularly in order to permit a supply of water along a full circumference.

In one refinement of the invention, it can be provided that at least two distribution chambers are formed and are connected to one hose connection each and are each guided to a plurality of outlet openings. It is of advantage here that the arrangement of the emerging water jets can be formed independently of the arrangement of the hose connection points. The two distribution chambers are preferably formed curved in a C-shaped manner as already described and/or oriented concentrically with respect to each other. It is of advantage here that the spaced-apart, laterally offset arrangement of the hose connection points with respect to each other can be neutralized in the outlet jet pattern of the sanitary outlet piece. Concentric arrangements of the different outflowing volumes of water can therefore be achieved.

In one refinement of the invention, it can be provided that at least two arrangements of outlet openings are formed on the outlet side, wherein each arrangement is connected to a hose connection point. It is of advantage here that the arrangement of the emerging volumes of water can be configured independently of the arrangement of the hose connection points. The arrangements are preferably arranged concentrically with respect to one another, as a result of which a particularly attractive outlet pattern is produced. The arrangements can each provide the already mentioned plurality of outlet openings.

It can also be provided that individual or all of the hose connection points are brought together on the outlet side or in the basic body to form a jet. For example, an addition of syrup or taste and/or odor components to water can be set up. Other hose connection points can be guided separately therefrom.

In one refinement of the invention, it can be provided that a plurality of outlet openings, for example the already mentioned plurality of outlet openings, is formed in at least one groove base of an outwardly open annular groove. It is of advantage here that a water flow which is distributed uniformly or virtually uniformly via the annular groove can be provided for a further configuration of the outlet jet pattern. The outlet openings which are arranged in the groove base are preferably assigned here to a common hose connection point.

In one refinement of the invention, it can be provided that the hose connection points are formed on a first part of a basic body, and the outlet side is formed on a second part of the basic body. It is of advantage here that a complex geometrical internal structure can be divided into two parts which can be manufactured in a simple manner, in particular can be injection molded. It is particularly favorable here if the first part and the second part are connected to each other in an integrally bonded manner. A compact unit of a basic body can therefore be formed, said unit being insertable in a simple manner into a sanitary fitting. Additionally or alternatively, a form-fitting and/or a force-fitting connection can also be produced.

A particularly simple variant can make provision for the inlet side and the outlet side to be formed on a single-piece basic body. It can be provided here that the distribution chamber is of open design and is closed, for example, by a cartridge connected downstream, preferably a jet former cartridge. The distribution chamber can be arranged here, for example annularly, around an outlet nozzle for the remaining hose connection points.

In one refinement of the invention, it can be provided that a distribution chamber, for example the already mentioned distribution chamber, is formed at a connecting point between a first part, for example the already mentioned first part, and a second part, for example the already mentioned second part, of a basic body, for example the already mentioned basic body. It is of advantage here that the distribution chamber can be formed in a simple manner, for example can be injection molded, before the two parts are connected to each other. All of the already mentioned distribution chambers are preferably formed at this connecting point which, for example, lie through a plane which is preferably oriented transversely with respect to a longitudinal direction of the sanitary outlet piece. It is particularly favorable if the parts are connected in an integrally bonded manner.

In one refinement of the invention, it can be provided that a jet regulator and/or a jet former is/are connected downstream of at least one hose connection. Said jet regulator and/or jet former is preferably fitted outside the basic body. It is of advantage here that the emerging water jet which is supplied via the hose connection point can be regulated and/or shaped. The jet regulator and/or jet former can be integrated here in a preferably exchangeable cartridge. Retrofitting, maintenance and/or adaptation are/is thus possible in a simple manner.

In one refinement of the invention, it can be provided that at least two of the at least three hose connection points are guided to a common outlet nozzle. A jet outlet pattern can therefore be configured in an attractive manner. Different volumes of water can also be mixed in a simple manner. The outlet nozzle can therefore be manufactured with a low structural outlay. It is particularly favorable if the two hose connection points are formed with corresponding opening diameters. Hoses with comparable flow rates can therefore be connected and conducted to the common outlet nozzle.

In order to achieve the object mentioned, in the case of a sanitary fitting, the features of the further independent claim directed toward a sanitary fitting are provided. In particular, it is therefore proposed according to the invention in order to achieve the object mentioned in the case of a sanitary fitting that a sanitary outlet piece is designed according to the invention, in particular as previously described and/or as claimed in one of the claims directed toward a sanitary outlet piece, wherein the outlet piece is inserted into a fitting outlet. A conventional sanitary fitting can therefore be provided with the extended functionality, which is provided by the sanitary outlet piece according to the invention. Alternatively or additionally, it can be provided that at least one hose connection point is connected to an output of a metering and/or mixing device, in particular to a mixing cartridge. It is of advantage here that mixed water can be supplied to the sanitary outlet piece, for example via a hose connection point with an opening diameter which differs from the remaining hose connection points, in particular the largest or smallest opening diameter. It is furthermore of advantage that a known operation and maintainability of a sanitary fitting by an end customer can be made possible without additional knowledge, education and information since the known methods of a classic mouthpiece are used.

It is particularly favorable if the outlet piece is clamped in the fitting outlet. Secure support can therefore be achieved.

In one refinement of the invention, it can be provided that a hose which has a holding groove is arranged on each hose connection point, wherein a holding plate with a recess engages laterally in the holding groove in order to fix the hose in its longitudinal direction on the hose connection point. The hoses are therefore connectable without a thread. The holding nut is preferably of encircling design. The hose can therefore be plugged in and held in all orientations.

In one refinement of the invention, it can be provided that a jet former cartridge is connected downstream of the basic body. An attractive jet pattern, for example an aerated jet, can therefore be achieved. It can preferably be provided that a connecting piece of the jet former cartridge projects over a plane defined by a supporting edge, with which the jet former cartridge lies against the basic body. A safety feature which prevents a connection of a non-fitting cartridge is therefore formed.

Alternatively or additionally, it can be provided that a connecting piece, in particular the already mentioned connecting piece, engages in a corresponding connecting-piece receptacle on the basic body. A further safety feature which prevents connection of a non-fitting cartridge is therefore formed.

In one refinement of the invention, it can be provided that the outlet piece is held by an outlet element. The outlet element here can be, for example, an outlet sieve and/or an outlet rectifier. Alternatively or additionally, the outlet element can have a jet regulator, for example the already mentioned jet regulator, and/or a jet former, for example the already mentioned jet former. It is of advantage here that an outlet element, the function of which can be impaired, for example, by soiling, is removable and replaceable in a simple manner without the sanitary outlet piece having to be removed or exchanged.

In one refinement of the invention, it can be provided that at least one leakage outlet is formed on the basic body, said leakage outlet connecting a space adjacent to the more than two hose connection points to an external environment. This space can be, for example, an internal space of a fitting outlet, into which the outlet piece according to the invention is insertable and/or is inserted. It is of advantage here that a water accumulation which occurs at one of the hoses or at one of the hose connection points due to leakage is detectable in a simple manner. This can take place, for example, by an emergence of water at the at least one leakage outlet being observed. It is therefore possible to avoid the space mentioned from completely filling with water. It can therefore be prevented that water escaping in the form of leakage in the fitting, but outside the hoses, flows back under a washstand or the like. It is particularly favorable if the leakage outlet opens outwards on the outlet side. The leakage outlet can be designed, for example, as a connecting recess (e.g. groove) or passage opening on the basic body. A modification of the fitting outlet is not required.

To achieve the objects mentioned and as a preferred application of the sanitary outlet piece, when an outlet piece is used the features of the further independent claim directed to the use of an outlet piece are provided. In particular, in order to achieve the object mentioned when an outlet piece is used, it is therefore proposed according to the invention that the outlet piece is designed according to the invention, in particular as described previously and/or as claimed in one of the claims directed toward an outlet piece, and is used in a sanitary fitting according to the invention, in particular as previously described and/or as claimed in one of the claims which is directed toward a sanitary fitting, wherein at least one hose connection point is connected to an output of a metering and/or mixing device, in particular of a mixing cartridge. It is of advantage here that, in addition to mixed water from the mixing cartridge, further volumes of water can be supplied unaffected by the mixed water to the sanitary outlet piece and can be conducted out of the latter. It is in each case preferably provided that the hose connection point which is connected to the output of the metering and/or mixing device is that with an opening diameter which differs from the remaining hose connection points, in particular the largest or smallest opening diameter. However, other configurations of the individual opening diameter can also be formed.

In one refinement of the invention, it can be provided that a hose connection point as a hot water hose connection point is connected to an outlet for hot water. In addition to mixed water, hot water, for example virtually boiling water, as is usable for the preparation of hot drinks, can therefore be provided. Alternatively or additionally, it can be provided that a hose connection point as cold hose connection point is connected to an outlet for cold water. In addition to mixed water, cold water, for example for the preparation of cold drinks or else for certain medical applications, can therefore preferably be provided.

Alternatively or additionally, it can be provided that a hose connection point as an enriching hose connection point is connected to an outlet for enriched water, in particular for water enriched with $CO_2$. It is of advantage here that a sanitary outlet piece of the configuration according to the invention can be used for preparing mixed drinks.

BRIEF DESCRIPTION OF THE DRAWINGS

The invention will now be described in more detail with reference to an exemplary embodiment, but is not restricted to said exemplary embodiment. Further exemplary embodiments emerge from a combination of the features of individual or of a plurality of claims with one another and/or with individual or a plurality of features of the exemplary embodiment.

In the drawings

DETAILED DESCRIPTION

First of all, FIGS. 1 to 22 will be described together below.

A sanitary outlet piece denoted as a whole by 1 has an inlet side 2 on which three hose connection points 3, 4, 5 are formed.

Figure 2:
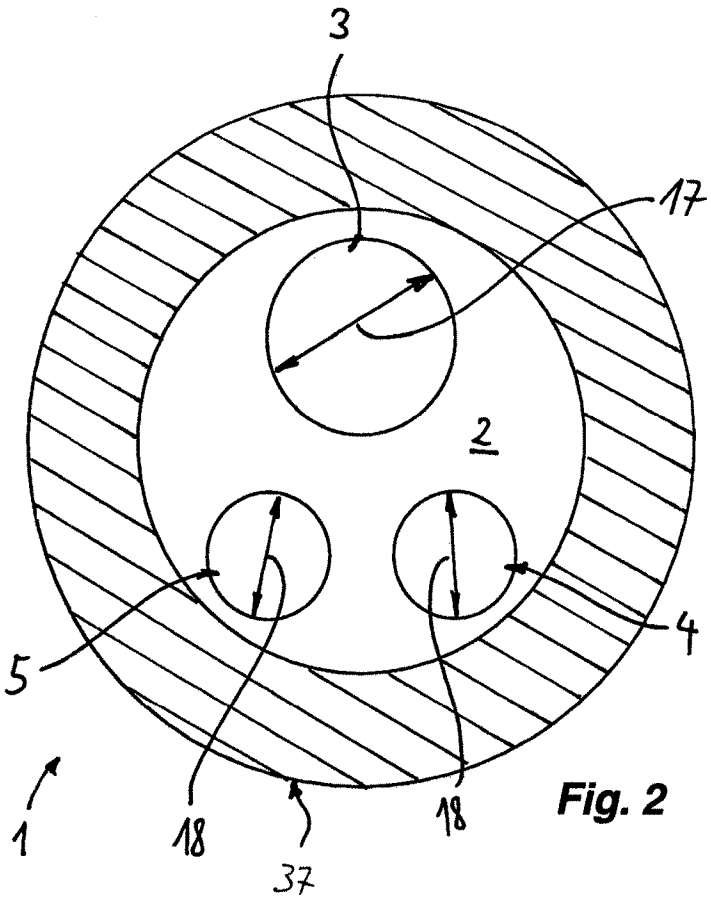
FIG. 2 shows the inlet side of the outlet piece in the fitting outlet according to FIG. 1 in a view from above with the hoses removed.
Figure 1:
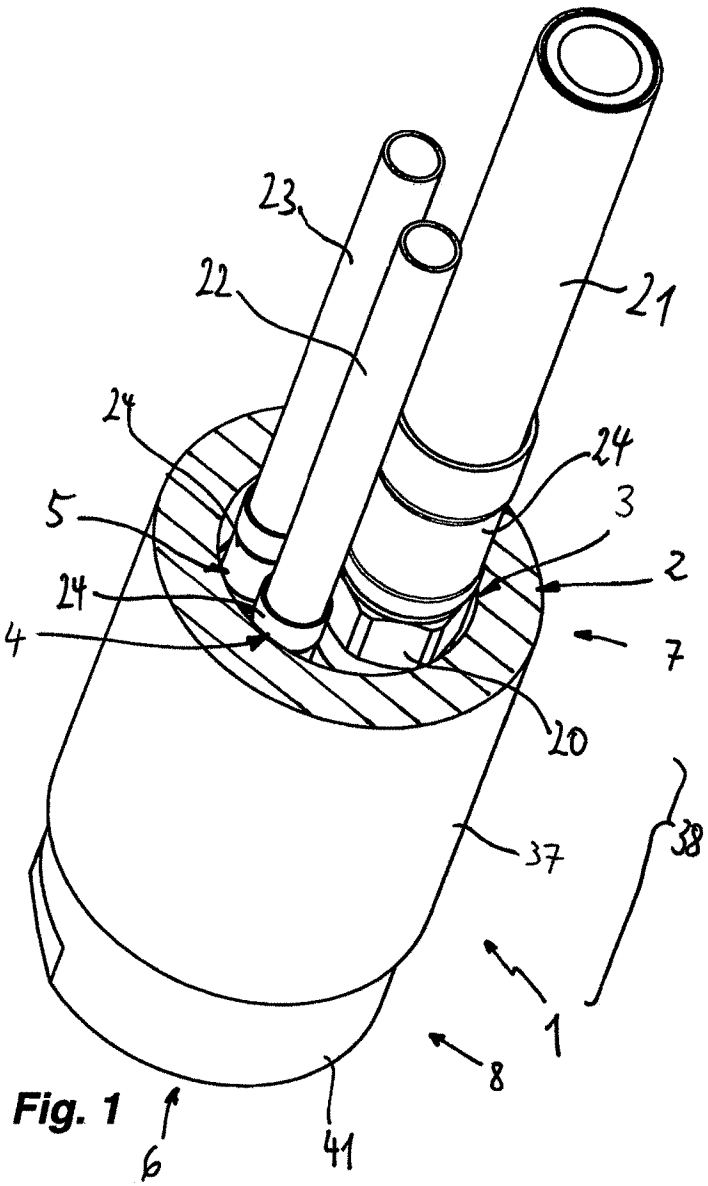
FIG. 1 shows a sanitary outlet piece according to the invention with connected hoses and cut-open fitting outlet in a three-dimensional perspective view.
Figure 4:
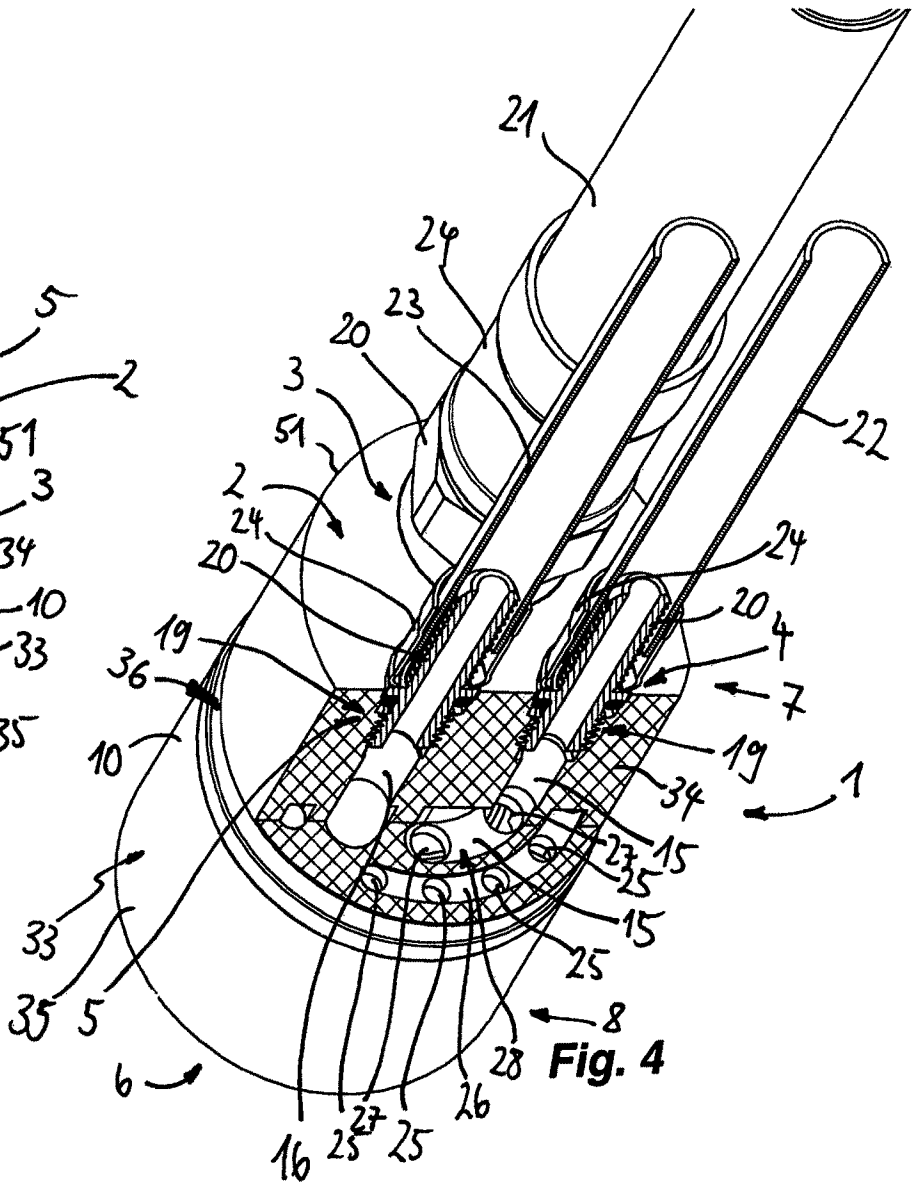
FIG. 4 shows the removed outlet piece according to FIG. 1 in a further partially cut-open illustration.
Figure 3:
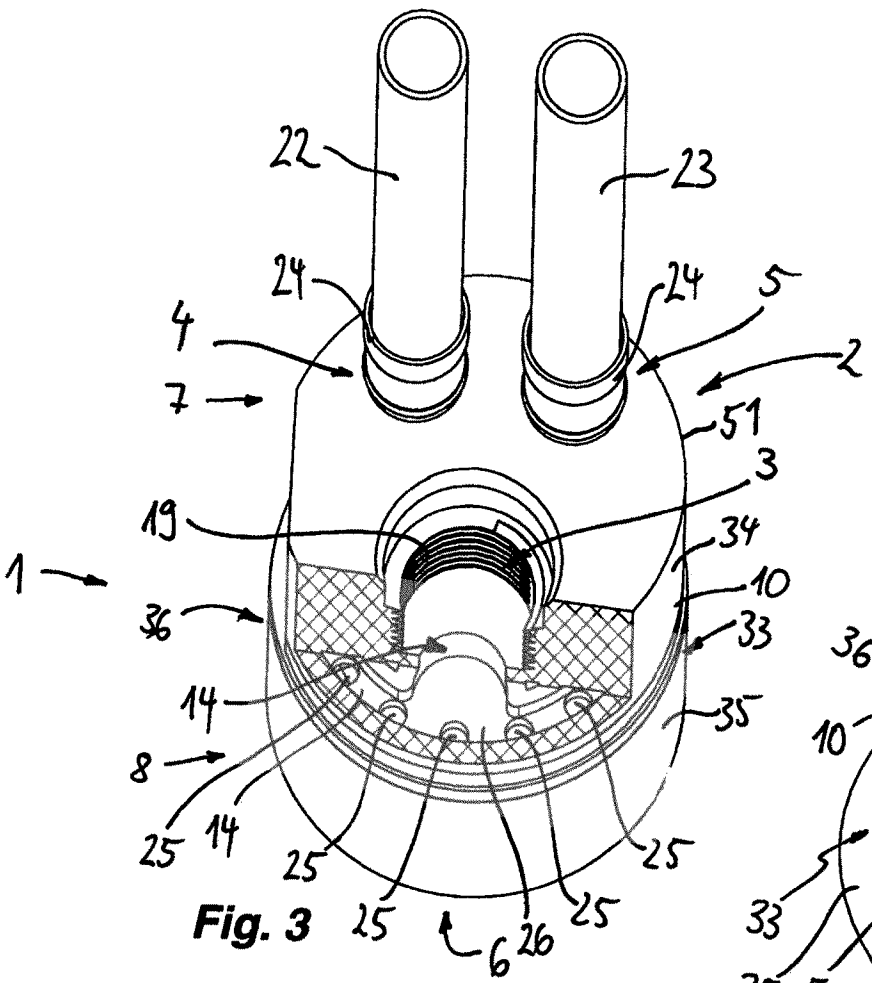
FIG. 3 shows the removed outlet piece according to FIG. 1 in a partially cut-open illustration.

It is apparent from FIG. 2 in particular that the hose connection points 3, 4, 5 are formed in a manner spaced apart from one another and therefore offset laterally in relation to one another.

Each of the hose connection points 3, 4, 5 is guided in a manner still to be described in more detail to an outlet side 6 of the sanitary outlet piece.

The inlet side 2 and the outlet side 6 are formed here at mutually opposite ends 7, 8 of the sanitary outlet piece 1. The ends 7, 8 are arranged one behind another here in an insertion direction 9 (cf. FIG. 8) which runs substantially parallel to a direction of the water flowing through.

Figures 5, 6, 7:
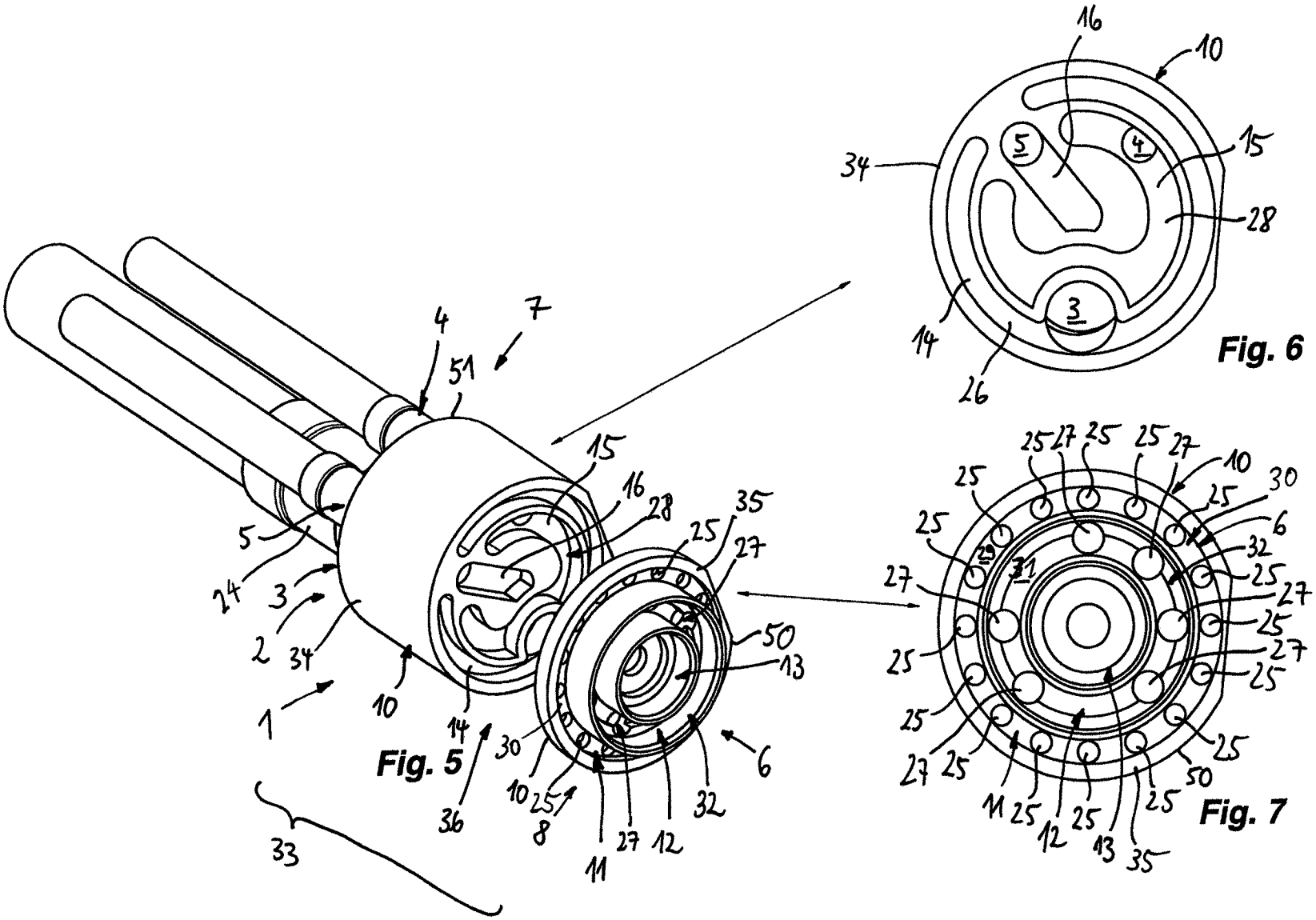
FIG. 5 shows the removed sanitary outlet piece according to FIG. 1 in an exploded illustration.
FIG. 6 shows a view of a connecting point formed on a first part of the outlet piece according to FIG. 5.
FIG. 7 shows a view of the outlet side of the sanitary outlet piece according to FIG. 5.
Figure 9:
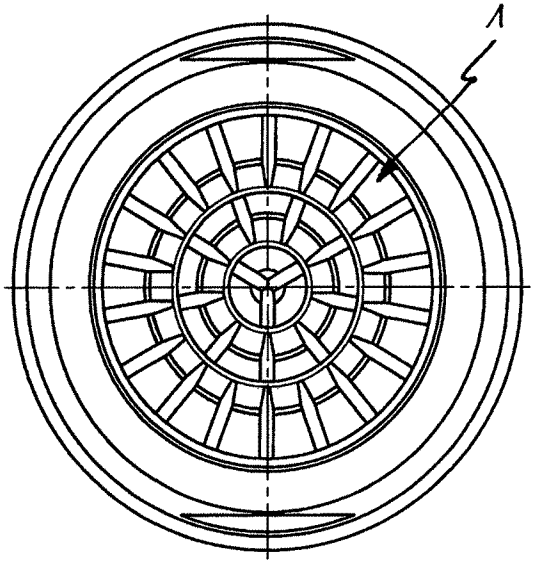
FIG. 9 shows a view from below of the installed sanitary outlet piece according to FIG. 1 in the fitting.

Two annularly encircling housing edges 50, 51 are formed between the inlet side 2 and the outlet side 6 (cf. FIG. 5).

Between the ends 7, 8, the sanitary outlet piece 1 has an encircling outer wall 10 (cf. FIGS. 3 to 7) which, by means of its shape, defines the mentioned insertion direction 9. The outer wall 10 is bounded on both sides by the housing edges 50 and 51. The inlet side 2 and the outlet side 6 are arranged in a manner spaced apart from each other by the outer wall 10.

In the exemplary embodiment, the outer wall 10 is of substantially cylindrical design and is inserted into a fitting outlet 38 of a sanitary fitting 37 from below, i.e. counter to a direction of flow.

The hose connection points 3, 4, 5, in each case taken by themselves, are guided separately from the inlet side 2 to the outlet side 6 in such a manner that no valves and no junctions for adding additional liquids or for mixing the volumes of water from the hose connection points 3, 4, 5 with one another takes place between the ends 7, 8.

Water outlets 11, 12, 13 which are separated from one another are formed on the outlet side 6. The water outlet 11 is connected here only to the hose connection point 3, the water outlet 12 is connected only to the hose connection point 4, and the water outlet 13 is connected only to the hose connection point 5.

In other words, a junction-free water duct 14 is formed between the hose connection point 3 and the water outlet 11 in the sanitary outlet piece 1. Similarly, a junction-free water duct 15 is formed between the hose connection point 4 and the water outlet 12 in the sanitary outlet piece 1. Finally, a water duct 16 is formed between the hose connection point 5 and the water outlet 13.

It can be seen in FIG. 2 that an opening diameter 17 of the hose connection point 3 is larger than an opening diameter 18 of the remaining hose connection points 4, 5.

An internal thread 19 into which a connecting piece 20 is in each case screwed is formed on each of the hose connection points 3, 4, 5.

A hose 21, 22, 23 which is in each case fastened in a manner known per se with a crimp sleeve 24 is plugged onto each of said connecting pieces 20.

An annular arrangement of outlet openings 25 which are connected to the hose connection point 3 via the water duct 14 is formed in the water outlet 11. A distribution chamber 26 is formed here in the water duct 14, via which distribution chamber water flowing in from the hose connection point 3 is substantially uniformly distributed to the outlet openings 25.

It is apparent in FIG. 6 that the distribution chamber 26 has a C-shaped curved shape which permits connection to all of the outlet openings 25.

It is apparent in FIG. 7 that the water outlet 12 has a second annular or C-shaped arrangement of outlet openings 27, which is oriented concentrically with respect to the arrangement of the outlet openings 25.

The outlet openings 27 are connected to the hose connection point 4 via a distribution chamber 28.

It is apparent in FIG. 6 that the distribution chamber 28 is likewise designed curved in a C-shaped manner in order to reach all of the outlet openings 27.

The outlet openings 25 are formed here in a groove base 29 of an annular groove 30. By contrast, the outlet openings 27 are formed in a groove base 31 of an annular groove 32.

The annular groove 30 is formed and arranged concentrically with respect to the annular groove 32.

The sanitary outlet piece 1 has a basic body 33 which is comprised of a first part 34 and a second part 35.

The hose connection points 3, 4, 5 are formed on the first part 34 while the outlet side 6 is formed on the second part 35 of the basic body 33.

The first part 34 and the second part 35 are connected to each other in an integrally bonded manner. In further exemplary embodiments, the parts 34 and 35 are alternatively or additionally connected in a form-fitting and/or force-fitting manner.

The distribution chambers 26, 28 are formed at the connecting point 36 between the first part 34 and the second part 35. The distribution chambers 26, 28 are formed here in the first part 34 onto which the second part 35, which is designed as a distribution plate, is finally placed and connected.

A jet regulator (not illustrated specifically) and/or jet former is connected downstream of the sanitary outlet piece 1 on the outlet side 6.

Figure 8:
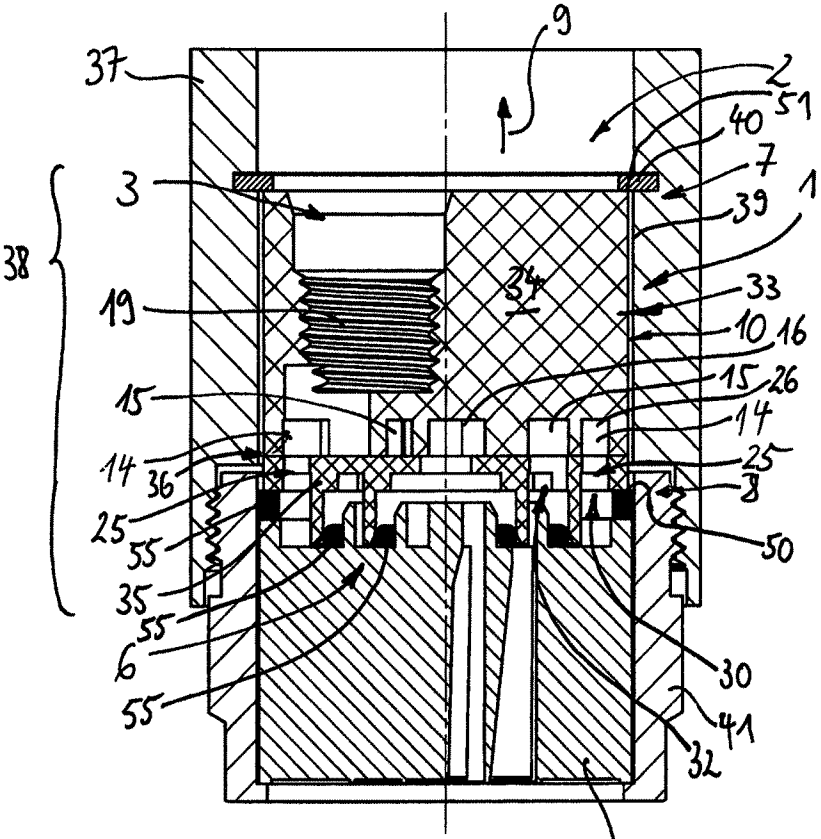
FIG. 8 shows the use according to the invention of the outlet piece according to FIG. 1 in a sanitary fitting.

For use of the sanitary outlet piece 1, the outlet piece 1 is inserted into a sanitary fitting 37 indicated in FIG. 8.

For this purpose, the sanitary fitting 37 has an outlet fitting 38 on which a tubular receptacle 39 is formed. The inner contour of the tubular receptacle 39 is coordinated with the outer contour of the outer wall 10 in such a manner that the sanitary outlet part 1 fits with its basic body 33 into the tubular receptacle 39.

During use according to the invention, the sanitary outlet piece 1 is therefore inserted into the tubular receptacle 39 until said sanitary outlet piece lies against the stop 40.

Subsequently, a screw sleeve 41 as a mouthpiece with an outlet element 42 is screwed into the fitting outlet 38. The sanitary outlet piece 1 is thereby clamped between the stop 40 and the outlet element 42. The outlet element 42 can have, for example, a jet regulator, a jet former, an outlet rectifier and/or an outlet sieve. Sealing rings 55 provide a seal with respect to the second part 35.

Figure 10:
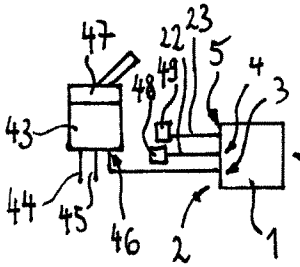
FIG. 10 shows a schematic illustration of the use according to the invention of a sanitary outlet piece according to the invention according to FIG. 5 on a metering and/or mixing device.

In addition, the hose 21 is connected to a metering and/or mixing device 43 which is illustrated schematically in FIG. 10 and is known per se, for example a mixing cartridge. The metering and/or mixing device 43 here has a hot water inlet 44, a cold water inlet 45 and—on the same, lower side—an outlet 46 for mixed water which is charged, for example, from the inlets 44, 45 via a two-way lever 47. In contrast to the outlet piece 1, the metering and/or mixing device 43 therefore has a mixing valve in the interior, and the water inlets 44, 45 are guided back to the same side. The hoses 22, 23 at the hose connection points 4, 5 are connected to an outlet 48 for hot water or to an outlet 49 for cold water.

The hose connection point 4 can thereby be used, for example, as a cold hose connection point and the hose connection point 5 as a hot hose connection point.

Alternatively or additionally, one of the hoses 22, 23 is usable with an outlet for enriched water, for example for water enriched with $CO_2$, as a result of which an enrichment hose connection point can be formed at the hose connection point 4 or 5. A hose connection point can also be charged with taste and/or odor additives, for example syrup.

Figure 13:
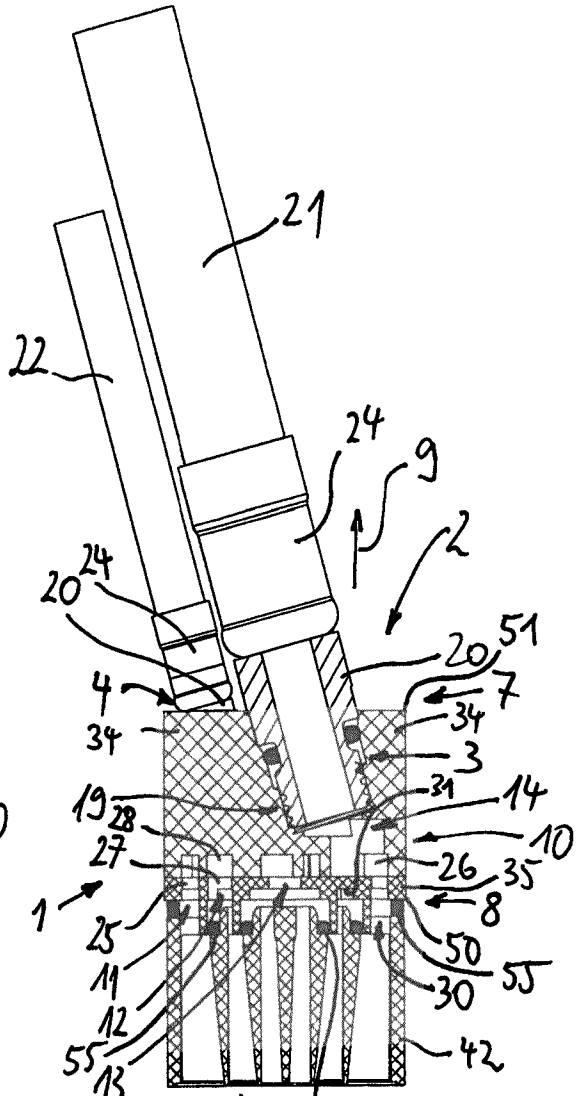
FIG. 13 shows a sectional illustration for FIG. 12.
Figure 12:
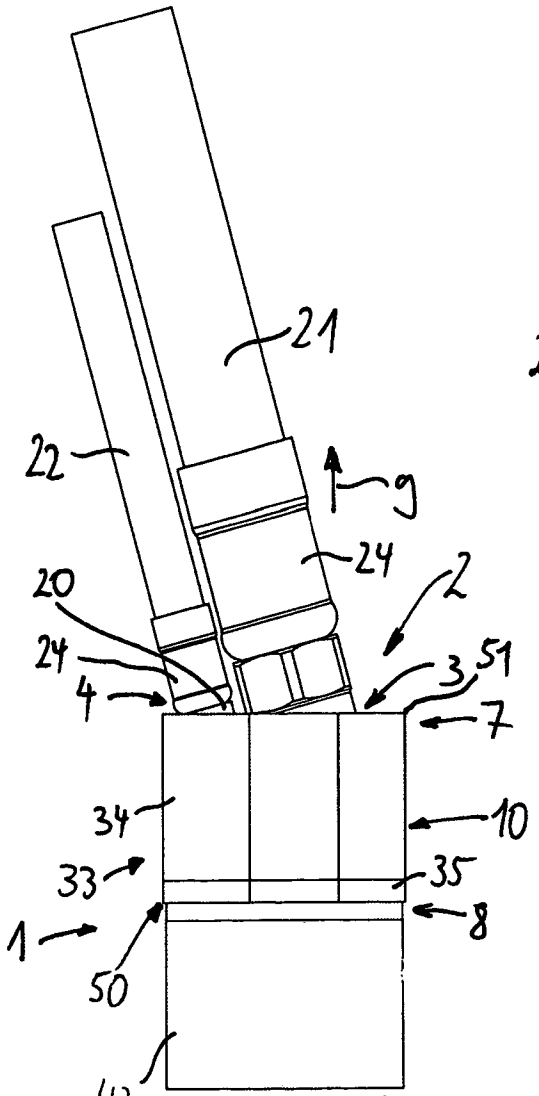
FIG. 12 shows a side view of the outlet piece according to FIG. 11.
Figure 11:
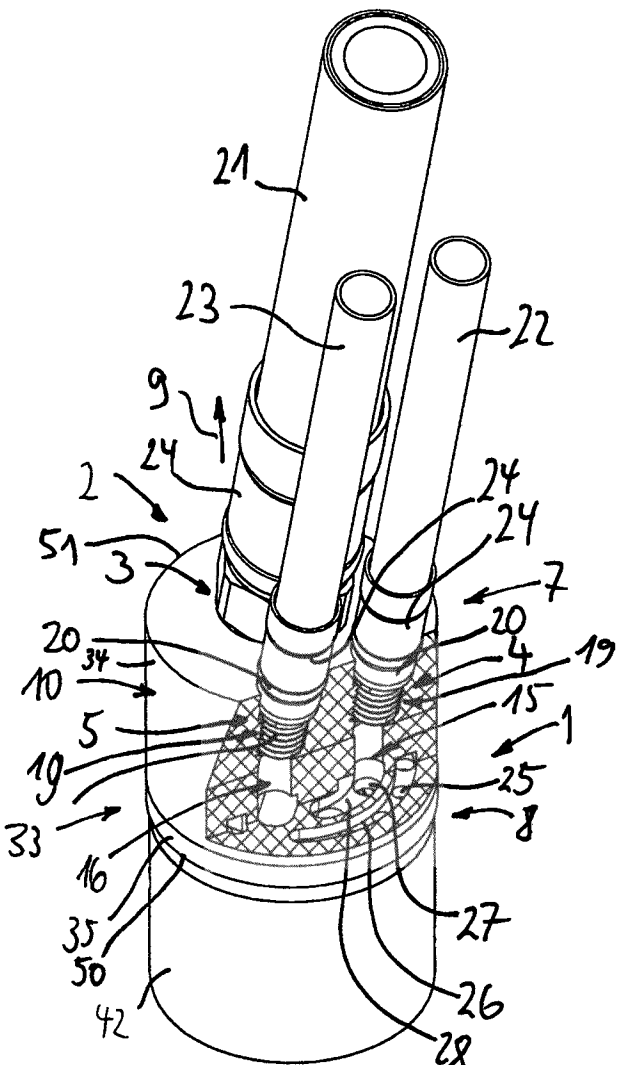
FIG. 11 shows a further sanitary outlet piece according to the invention with hose connection points inclined obliquely in relation to a longitudinal direction and hoses connected thereto, in a partially cut-open, three-dimensional perspective view.
Figure 15:
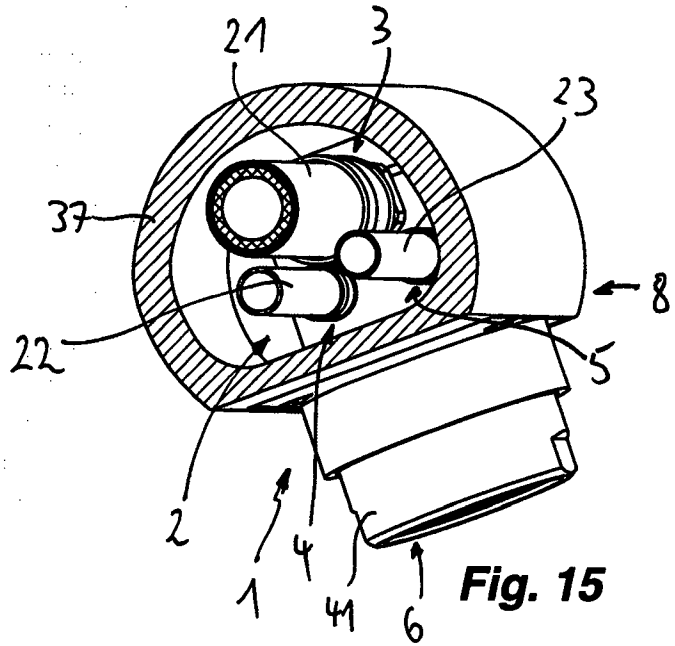
FIG. 15 shows a further sectional illustration of the arrangement according to FIG. 14.
Figure 14:
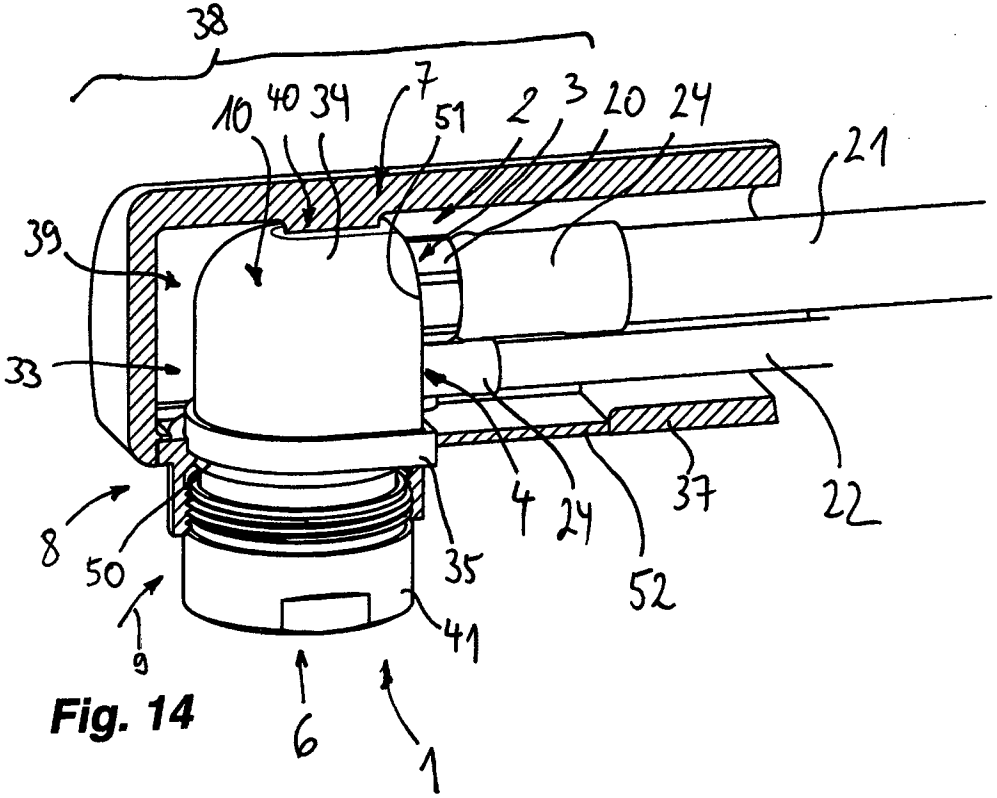
FIG. 14 shows a further sanitary outlet piece according to the invention in the form of an angle piece in a fitting outlet, in which the water outlet is oriented perpendicularly to a direction in which the fitting outlet runs, in a partially cut-open illustration looking at the interior of the sanitary fitting.

FIGS. 11 to 13 show a further exemplary embodiment according to the invention of a removed sanitary outlet piece 1 in various views. Components and functional units which are structurally and/or functionally similar or identical to the preceding exemplary embodiment are denoted by the same reference signs and are not described separately once again. The statements regarding FIGS. 1 to 10 therefore apply correspondingly to FIGS. 11 to 13.

The exemplary embodiment according to FIGS. 11 to 13 differs from the preceding exemplary embodiment in that the hose connection points 3, 4, 5 is not oriented parallel to a longitudinal direction, which can be predetermined by the insertion direction 9, but rather at an angle to said direction. This has the consequence that the screwed-in connecting pieces 20 are oriented at an angle to a longitudinal direction of the basic body 33. This permits a curved design of the sanitary fitting 37 which is not illustrated further here.

FIGS. 14 to 18 show a further exemplary embodiment according to the invention of a sanitary outlet piece 1. Again, components and functional units which are structurally and/or functionally similar or identical to the preceding exemplary embodiments are denoted by the same reference numbers and are not described separately once again. The statements regarding the preceding exemplary embodiments and in particular FIGS. 1 to 13 therefore apply correspondingly to FIGS. 14 to 18.

The exemplary embodiment according to FIGS. 14 to 18 differs from the preceding exemplary embodiments in that the outlet piece 1 is designed as an angle piece. This has the result that the inlet side 2 and the outlet side 6 are not spaced apart from each other, but rather are adjacent to each other and enclose an angle with each other.

Figures 16, 17, 18:
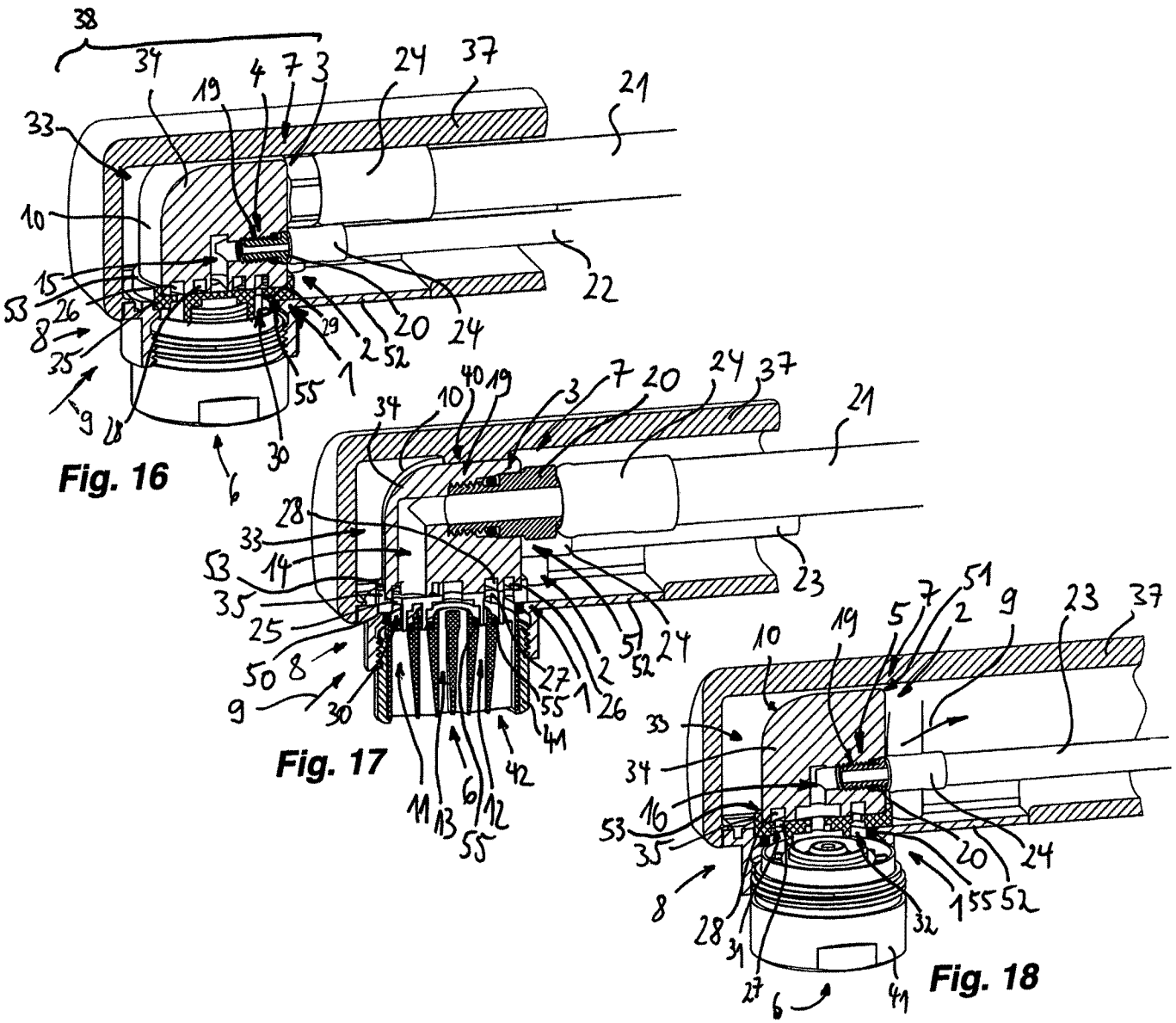
FIG. 16 shows a longitudinal sectional illustration through the arrangement according to FIG. 15 in a first intersecting plane.
FIG. 17 shows a longitudinal sectional illustration for FIG. 14 in a second intersecting plane displaced parallel in relation to FIG. 16.
FIG. 18 shows a third longitudinal sectional illustration for FIG. 14 in a further intersecting plane displaced parallel in relation to FIG. 16 and FIG. 17.

It is apparent from FIGS. 16 to 18 that the associated water ducts run at an angle between the hose connection points 3, 4, 5, on the one hand, and the respectively associated water outlets 11, 12, 13.

Also in the case of the exemplary embodiment according to FIGS. 14 to 18, the sanitary outlet piece 1 is inserted into a tubular receptacle 39, but not along the extent of said receptacle 39, but rather transversely with respect to the extent thereof.

This makes it possible for the water to be able to emerge transversely at an angle of 90° or at a different angle with respect to a direction of extent of the fitting outlet 38.

The combination of the various embodiments illustrated shows that the inlet from all directions, preferably separated or spaced apart from the outlet side 6, is possible.

The sanitary fitting 37 can therefore be of non-circular or particularly flat design.

In order to be able to fit the sanitary outlet piece 1, an insertion plate 52 is fastened to the sanitary fitting 37 with fastening means 54 (cf. FIGS. 19 to 22)—here screws—or in some other way and is arranged removably.

The screw sleeve 41 is screwed into said insertion plate 52, which is part of the fitting outlet, in order to press the sanitary outlet piece against a stop 40 and to hold it securely there. The insertion plate 52 therefore acts as a clamping plate.

The fastening of the insertion plate 52 is therefore designed in such a manner that the holding forces can be absorbed and dissipated via the sanitary fitting 37.

It can be seen in FIGS. 16 to 18 that an encircling holding projection 53 is formed on the second part 35 in order to hold the first part 34 of the basic body 33 at the predetermined place.

In contrast to the preceding exemplary embodiments, the parts 34, 35 are therefore not aligned with each other, but rather holding means are formed on one of the parts 34, 35 in order to hold the other part 34, 35 in a defined orientation.

Figure 19:
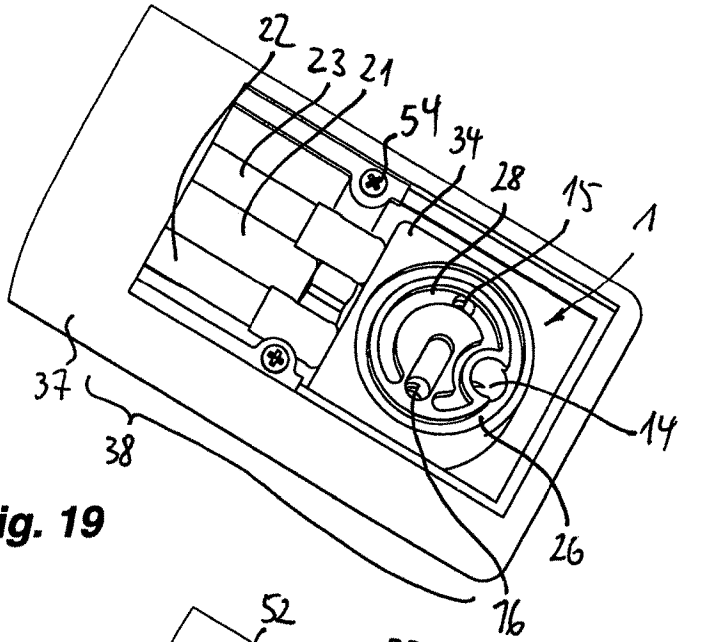
FIG. 19 shows a three-dimensional perspective view of the installed outlet piece, which is open at the separating point, according to FIG. 14 from below.
Figure 20:
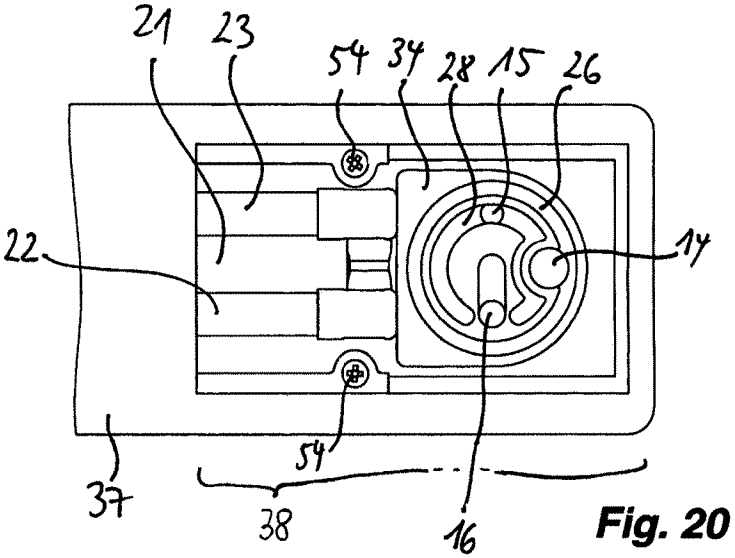
FIG. 20 shows a top view from below of the installed outlet piece, which is open at the separating point, according to FIG. 19.

In FIGS. 19 and 20, the second part 35 of the basic body 33 has been removed such that the inner distribution chambers 26, 28 are visible. After insertion of the first part 34 with the hoses 21, 22, 23, the second part 35 is attached (not illustrated). The outlet element 42 is subsequently attached to the second part. Sealing rings 55 (cf. FIGS. 16 to 18) are placed in the outlet element 42 in order to tightly connect the water outlets 11, 12, 13.

Figure 21:
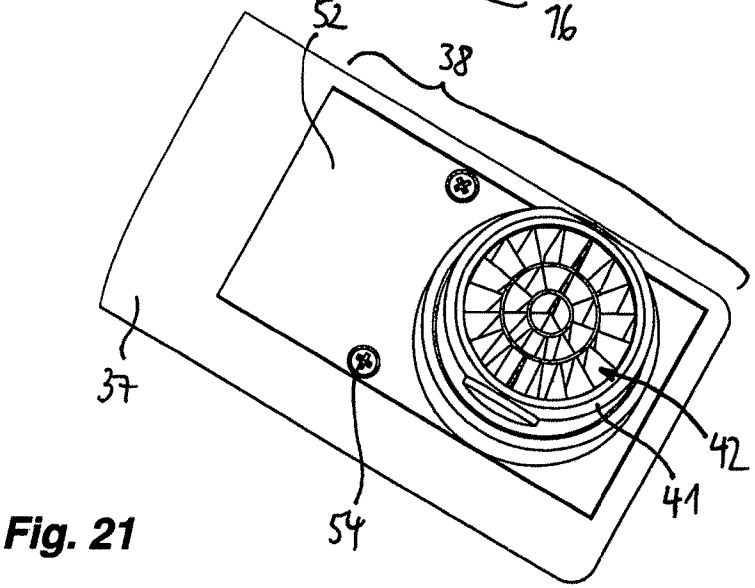
FIG. 21 shows a three-dimensional perspective view of the installed outlet piece with attached outlet element according to FIG. 14 from below.
Figure 22:
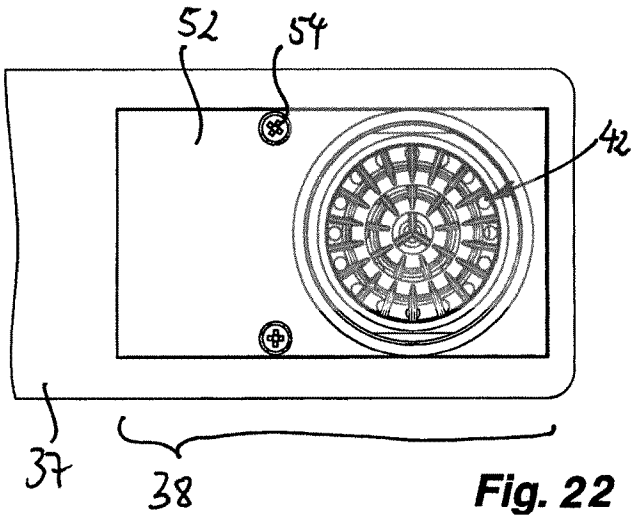
FIG. 22 shows a top view from below of the view according to FIG. 21.
Figures 23, 24:
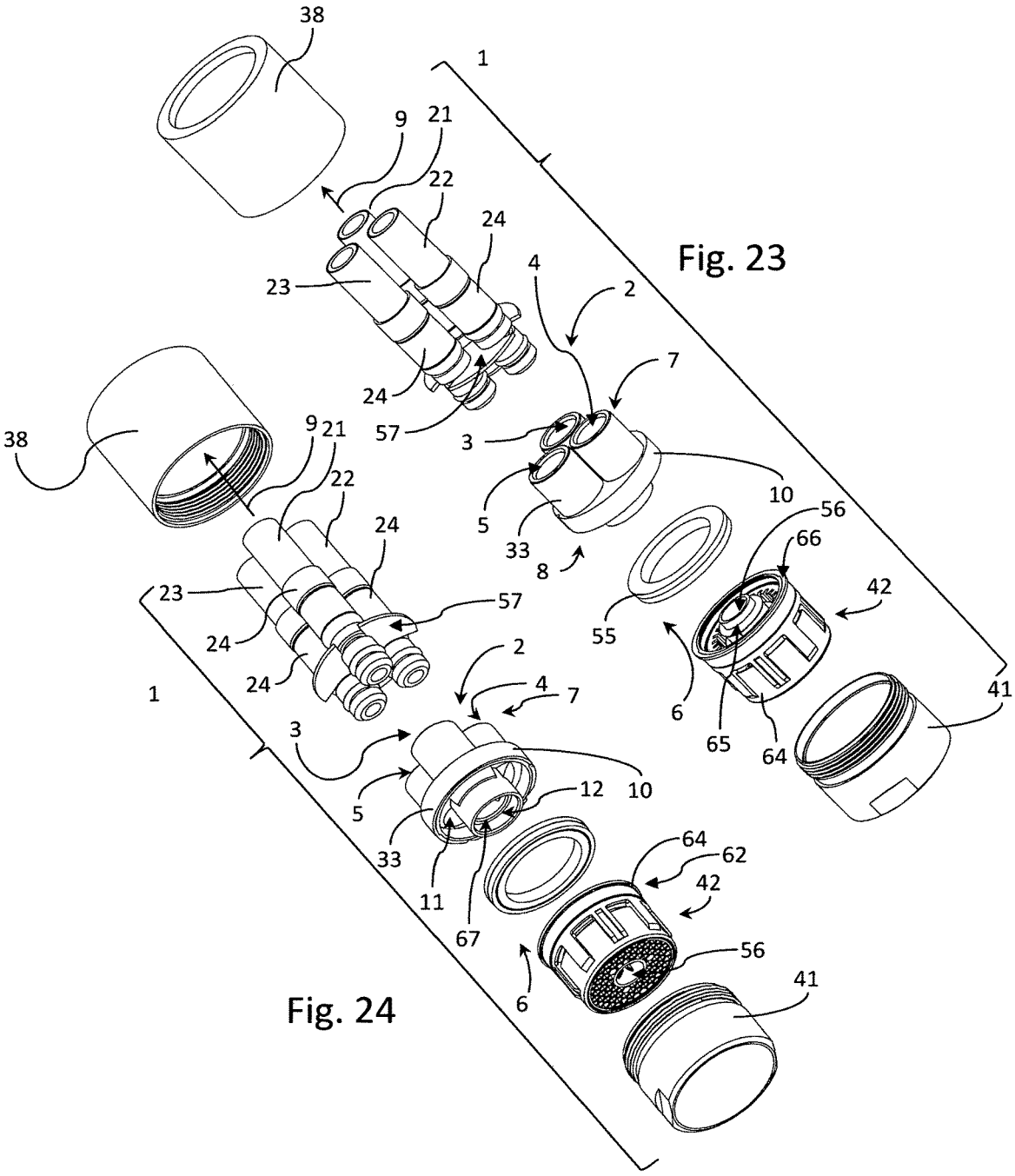
FIG. 23 shows a further outlet piece according to the invention in an exploded illustration of the inlet side.
FIG. 24 shows the outlet piece according to FIG. 23 in an exploded illustration of the outlet side.
Figure 26:
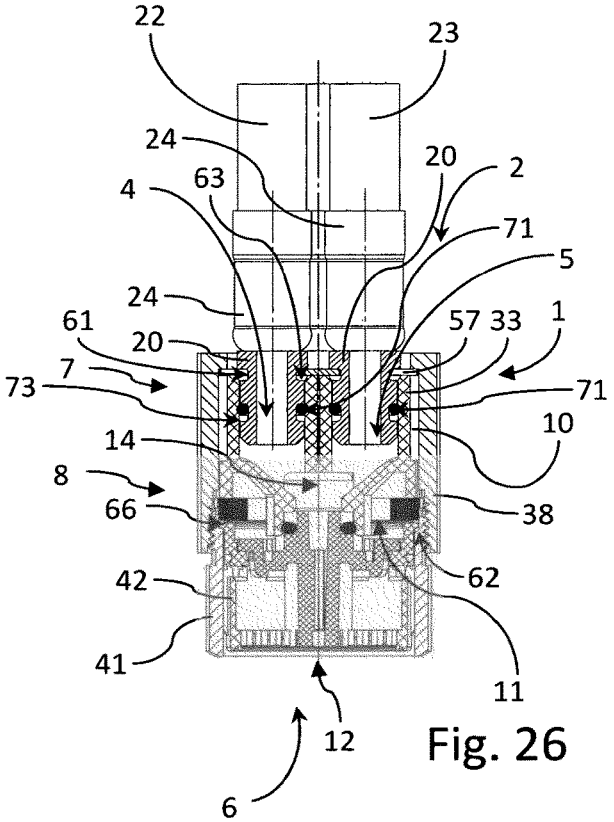
FIG. 26 shows a sectional illustration along the intersecting plane according to FIG. 25.
Figure 25:
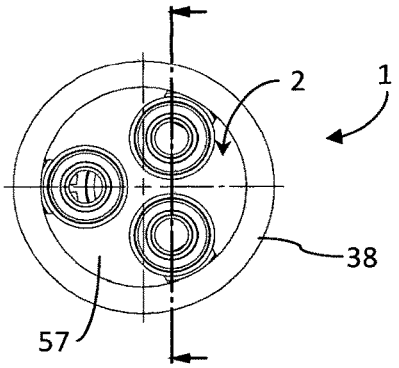
FIG. 25 shows the outlet piece according to FIGS. 23 and 24 in a top view of the inlet side with an intersecting plane.

FIGS. 21 and 22 show the attached outlet element 42 which is fastened with the screw sleeve 41. The screw sleeve 41 is screwed here onto the insertion plate 52 after the insertion plate 52 has been fastened with the fastening means 54 to the sanitary fitting 37.

FIGS. 23 to 35 show a further outlet piece 1 according to the invention in various views. These figures will now be described together. Components and functional units which are structurally and/or functionally similar or identical to the preceding exemplary embodiment are denoted by the same reference signs and not described separately. The statements with regard to FIGS. 1 to 22 therefore apply correspondingly to FIGS. 23 to 35.

The exemplary embodiment according to FIGS. 23 to 35 already differs from the preceding exemplary embodiment in that the hoses 21, 22, 23 are not screwed into the respective hose connection point 3, 4, 5. On the contrary, the hose connection points 3, 4, 5 are each designed to be thread-free with a smooth inner wall 69.

The hoses 21, 22, 23 are plugged here into the respective hose connection point 3, 4, 5.

For the axial fixing of the hoses 21, 22, 23, there is a holding plate 57 which is designed in the shape of a disk and is provided with recesses 58, 59, 60 corresponding to the hose connection points 3, 4, 5.

A hose 21, 22, 23 is in each case insertable laterally, i.e. transversely with respect to a longitudinal direction of the respective hose 21, 22, 23, into each recess 58, 59, 60 and is inserted in the use position. It can be seen in the figures that the recesses 58, 59, 60 open outward (in a plane defined by the holding plate 57) such that the hoses 21, 22, 23 are insertable into the recesses 58, 59, 60 by an insertion movement directed toward one another.

An encircling holding groove 61 is formed on each hose 21, 22, 23. In the example, said holding groove 61 is formed on the crimp sleeve 24. In the use position, the holding plate 57 engages with its recess 58, 59, 60 in the respective holding groove 61 such that the respective holding groove 61 engages on both sides over the holding plate 57 and fixes same axially, i.e. along the plugging-in direction of the hoses 21, 22, 23. Alternatively, instead of the holding groove 61, a holding edge 63 can be arranged which engages over the holding plate 57 on one side and thus prevents the respective hose 21, 22, 23 from slipping out (cf. FIGS. 41 and 42).

The holding plate 57 is inserted into a fitting outlet 38 which surrounds the recesses 58, 59, 60 in the manner of a ring. The fitting outlet 38 is arranged on the inlet side 2 such that the holding plate 57 is pressed against the basic body 33.

For this purpose, a screw sleeve 41 is formed with a mating thread (internal or external thread) which matches the fitting outlet 38 and is screwed to the fitting outlet 38. The fitting outlet 38 grips behind the basic body 33 (together with an outlet element 42 which is yet to be described, on the supporting edge 66 of said outlet element). The fitting outlet 38 therefore exerts a contact pressure against the holding plate 57. For this purpose, in a further embodiment, the fitting outlet 38 can be screwed to the basic body 33, and therefore the screw sleeve 41 can be dispensed with.

The exemplary embodiment according to FIGS. 23 to 35 furthermore differs from the preceding exemplary embodiment in that the distribution chamber 26, which coincides here with the water outlet 11, is not of C-shaped design, but rather is designed in the form of a closed ring. All-sided distribution of the water flow out of the hose connection point 3 can therefore be achieved in a simple manner.

In addition, it can be seen in the figures that the basic body 33, on which the inlet side 2 and the outlet side 6 are formed—separated by two housing edges 50, 51 and therefore at mutually opposite ends 7, 8—is integrally formed, for example by injection molding.

The hose connection points 4 and 5 are guided together to a water outlet 12 which opens into an outlet nozzle 56. Wing-shaped rectifying elements 68 are formed in the outlet nozzle 56, in order to form a calm or laminar water flow.

The outlet nozzle 56 is formed here on the outlet element 42 and completely passes through the latter in the longitudinal direction.

The outlet element 42 is a jet former cartridge 64 or another cartridge-shaped insert which is pressed by the screw sleeve 41 at a supporting edge 66 against the basic body 33 (via a sealing ring 55). The supporting edge 66 here forms a holding stop 62, against which the screw sleeve 41 presses.

By way of example, a diffuser which is known per se is shown in the interior of the jet former cartridge 64.

In contrast to commercially available jet former cartridges, this is provided on the inflow side with a connecting piece 65 which protrudes from the basic shape and in particular over the supporting edge 66. The connecting piece 65 connects into a corresponding connecting-piece receptacle 67 of the basic body 33. It is therefore possible to prevent a conventional jet former cartridge from being inadvertently installed instead of the special jet former cartridge 64. This is because the attachment screen of said conventional jet former cartridge prevents mounting on the connecting-piece receptacle.

A plurality of longitudinally running grooves or recesses are designed as leakage outlets 70 on the basic body 33, in the outer wall 10 thereof. Water which accumulates at the hose connection points 3, 4, 5 outside the hoses 21, 22, 23 but in the immediate vicinity thereof flows outward through said leakage outlet 70 via the outlet side 6 and the outlet element connected downstream. Leakages at the hoses 21, 22, 23 or the hose connection points 3, 4, 5 can therefore be easily seen from the outside before larger leakage amounts accumulate and cause greater damage. Leakage outlets 70 of this type can also be formed on the basic body 33 in the case of the exemplary embodiment according to FIGS. 1 to 22.

Figure 36:
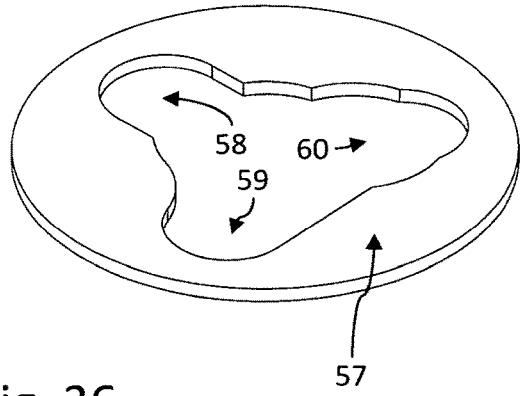
FIG. 36 shows a view of a further holding plate of the outlet piece according to FIG. 23.
Figure 37:
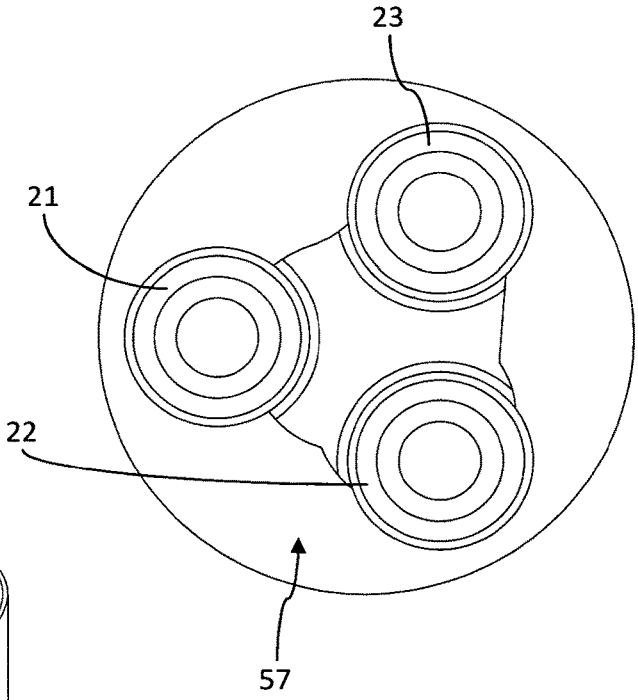
FIG. 37 shows a top view of the holding plate according to FIG. 36 with inserted hoses.
Figure 38:
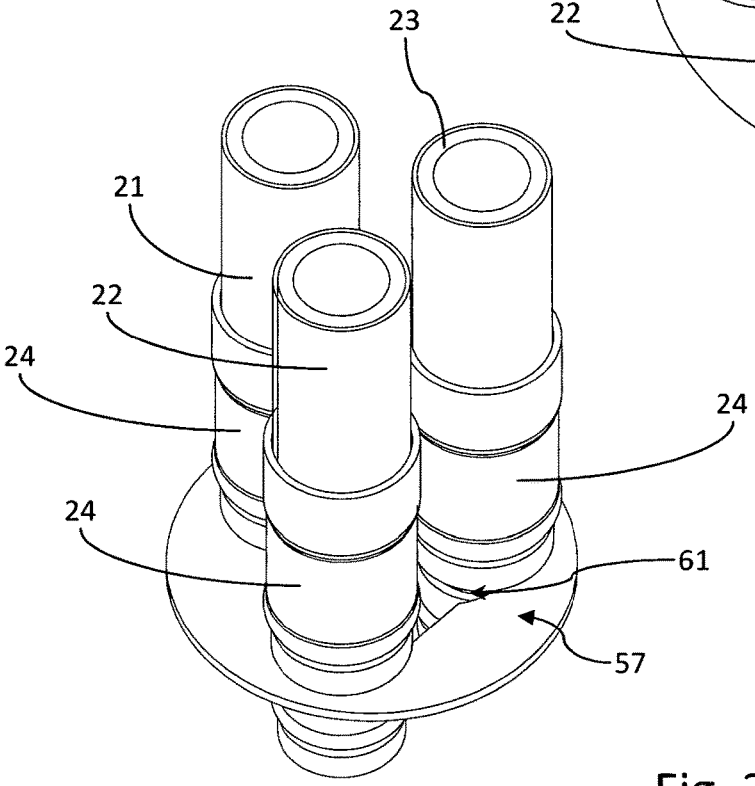
FIG. 38 shows a perspective view of the holding plate according to FIG. 36 with inserted hoses.

FIGS. 36 to 38 illustrate a further variant of the outlet piece 1 according to FIGS. 23 to 35 in various views. These figures will now be described together. Components and functional units which are structurally and/or functionally similar or identical to the preceding exemplary embodiment are denoted by the same reference signs and are not described separately. The statements with regard to FIGS. 1 to 35 therefore apply correspondingly to FIGS. 36 to 38. In particular, the holding plate 57 from FIGS. 23 to 35 can be replaced by the holding plate 57 according to FIGS. 36 to 38.

Only the holding plate 57 with the inserted hoses 21, 22, 23 are shown here; the other details are as per FIGS. 23 to 35. In actual fact, the holding plate 57 according to FIG. 36 can be inserted into the fitting outlet 38 since it has the same outer diameter as the holding plate 57 according to FIG. 33.

Figure 33:
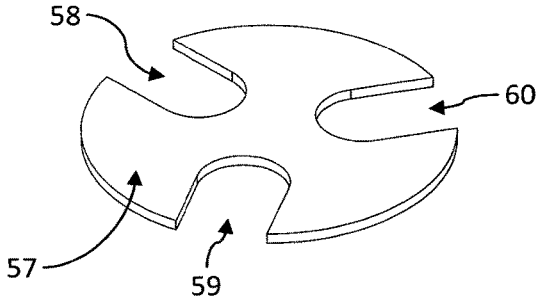
FIG. 33 shows a view of a holding plate of the outlet piece according to FIG. 23.
Figure 34:
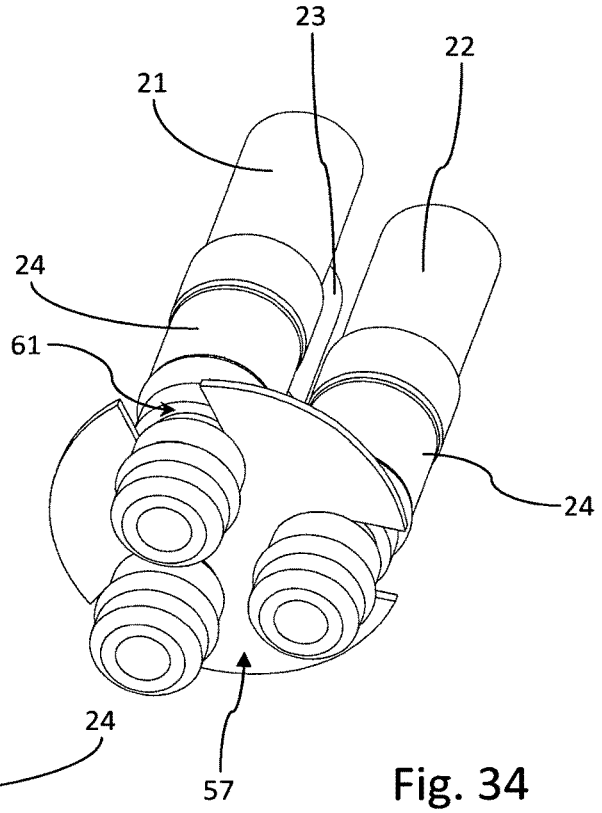
FIG. 34 shows a perspective view of the holding plate according to FIG. 33 with inserted hoses.
Figure 35:
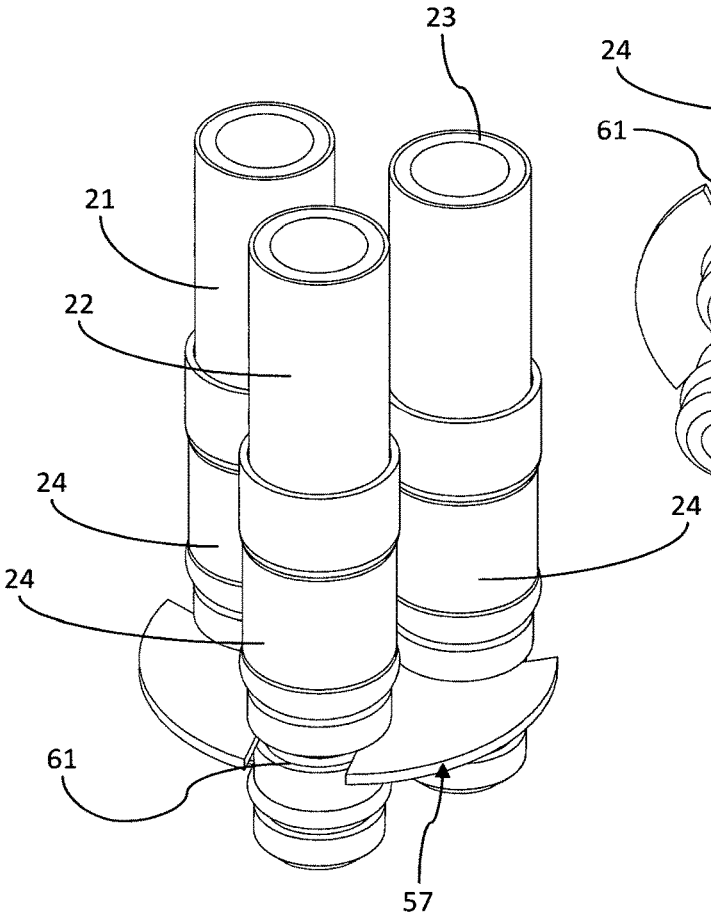
FIG. 35 shows a further perspective view of the holding plate according to FIG. 33 with inserted hoses.

The holding plate 57 differs from that according to FIG. 33 at least in that the three recesses 58, 59, 60 are now open inward such that the holding plate 57 describes a ring. The hoses 21, 22, 23 are furthermore inserted laterally, but now directed radially outward, into the corresponding recesses 58, 59, 60.

The contours of the holding plates 57 according to FIGS. 33 and 36 can also be combined with one another, for example by a sequence of inwardly and outwardly open recesses 58, 59, 60.

Figure 28:
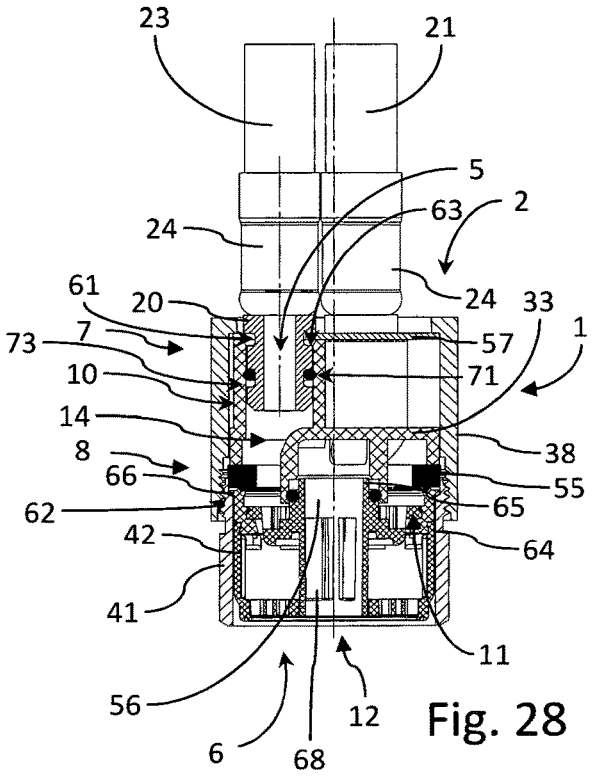
FIG. 28 shows a sectional illustration along the intersecting plane according to FIG. 27.
Figure 27:
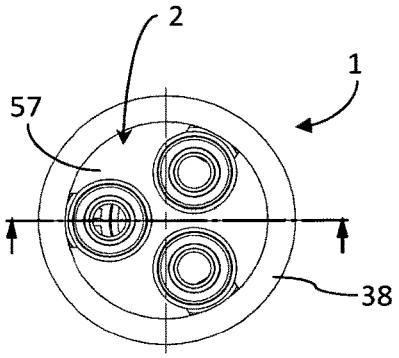
FIG. 27 shows the outlet piece according to FIGS. 23 and 24 in a top view of the inlet side with a further intersecting plane.
Figure 29:
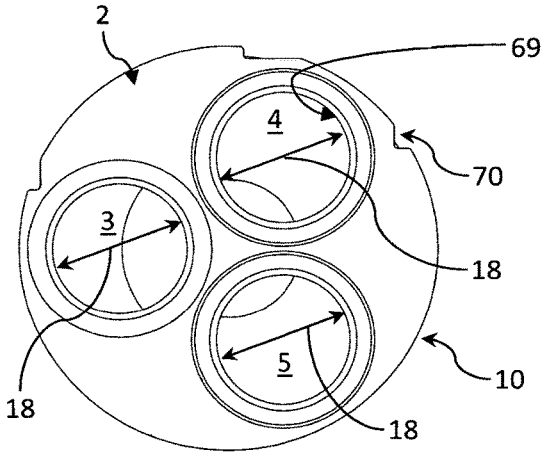
FIG. 29 shows a top view of the inlet side of the basic body of the outlet piece according to FIG. 23.
Figure 30:
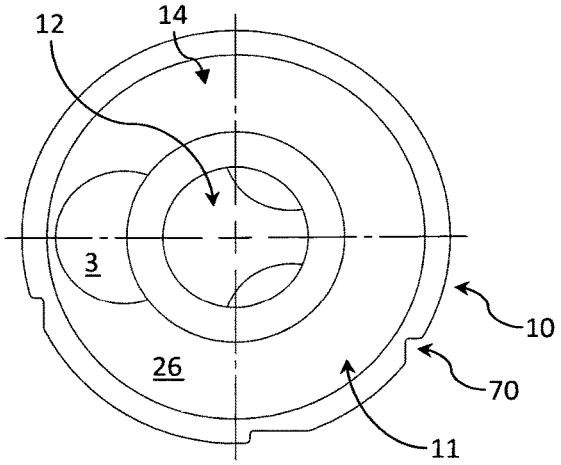
FIG. 30 shows a top view of the outlet side of the basic body of the outlet piece according to FIG. 23.
Figure 31:
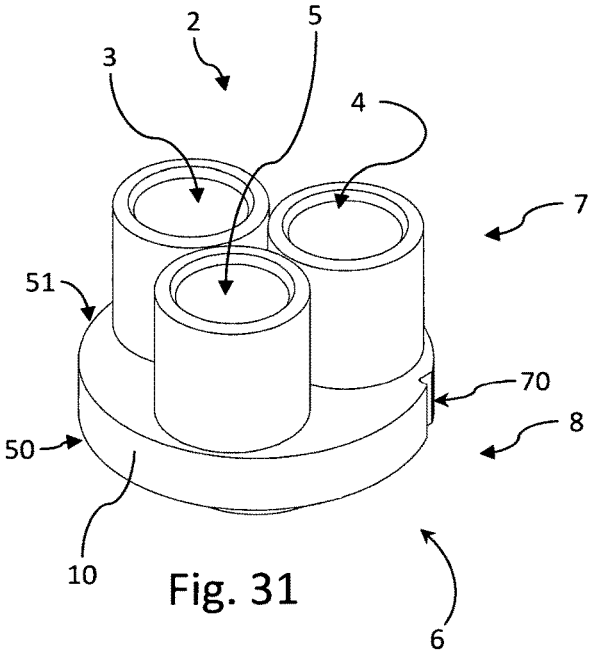
FIG. 31 shows a three-dimensional perspective view of the inlet side of the basic body of the outlet piece according to FIG. 23.
Figure 32:
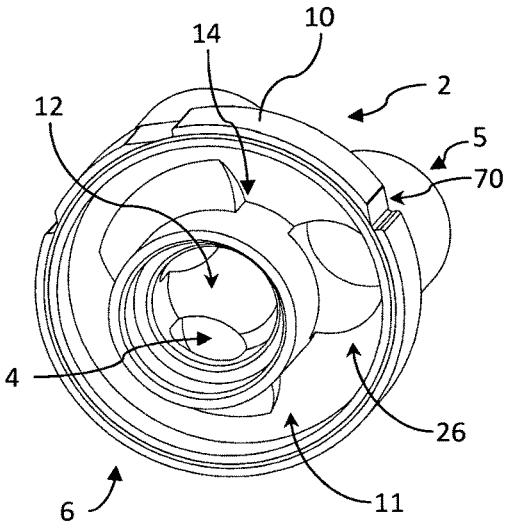
FIG. 32 shows a three-dimensional perspective view of the outlet side of the basic body of the outlet piece according to FIG. 23.

It is apparent in FIG. 28 that the hose 23 is sealed in the hose receptacle 5 by a sealing ring 71. The sealing ring 71 is axially secured here in a groove 73. The hoses 21, 22 are sealed in the same manner. A plug-in seal is therefore in each case formed.

Figure 39:
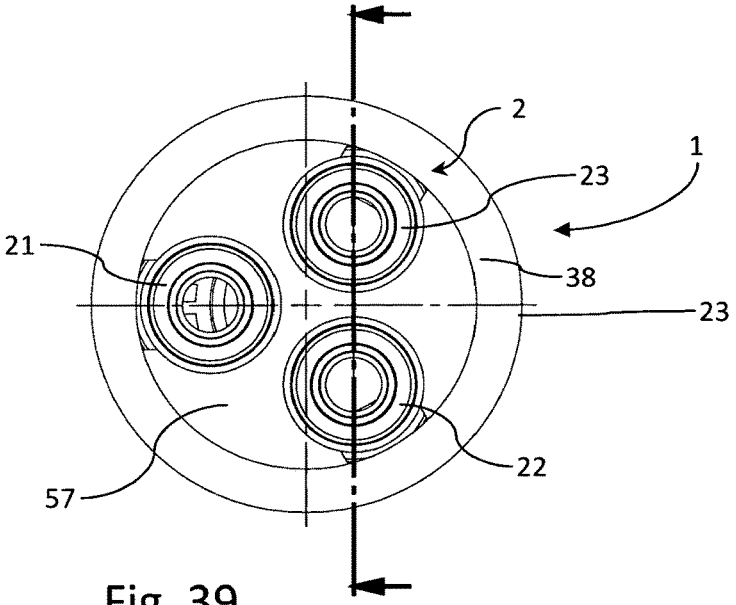
FIG. 39 shows a top view of the inlet side of the basic body of the outlet piece in a further exemplary embodiment.
Figure 40:
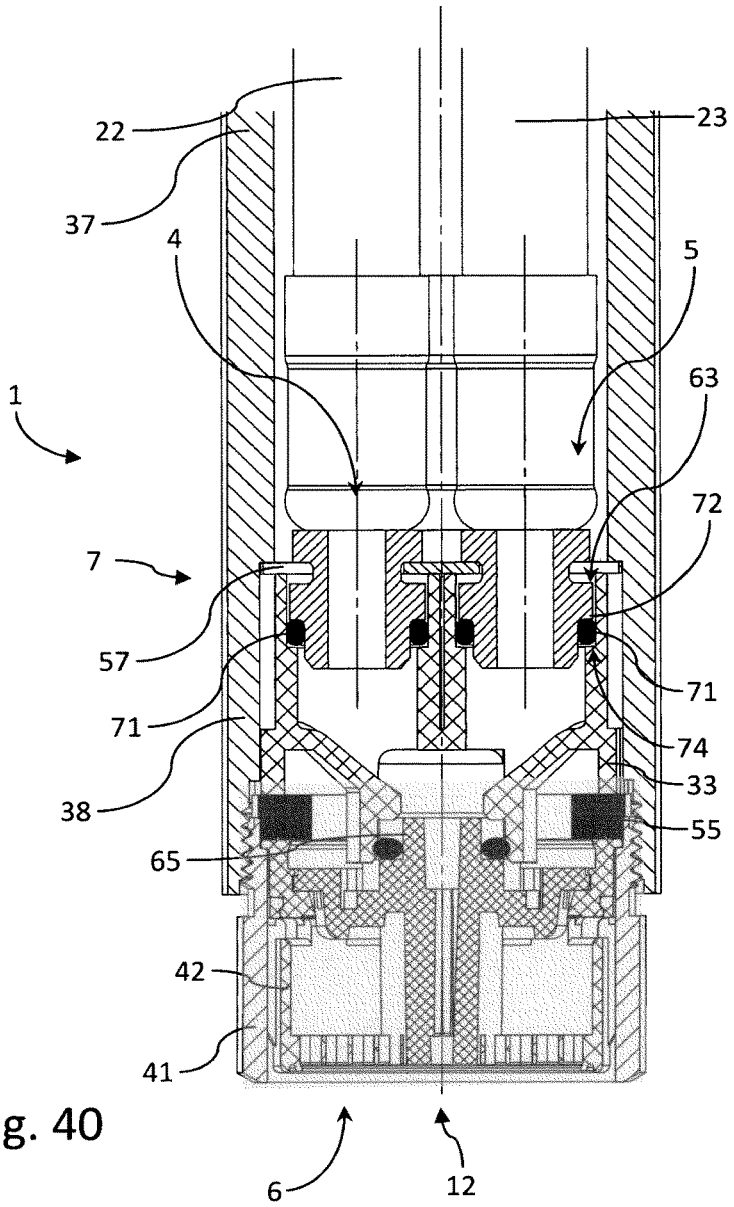
FIG. 40 shows a sectional illustration along the intersecting plane according to FIG. 39.

FIGS. 39 and 40 show a further sanitary outlet piece 1 according to the invention. Components and functional units which are structurally and/or functionally similar or identical to the preceding exemplary embodiments are denoted by the same reference signs and are not described separately. The statements with regard to FIGS. 1 to 38 therefore apply correspondingly to FIGS. 39 and 40.

The exemplary embodiment according to FIGS. 39 and 40 differs, for example, from the exemplary embodiment according to FIG. 28 in that each sealing ring 71 is held on a shoulder 72 on one side. A further shoulder 74 is formed on the associated hose receptacle 4, 5 such that overall an axial securing of the sealing ring 71 arises which is comparable to the action of the groove 73 in FIG. 28. The sealing in the further hose receptacle 3 takes place analogously.

Figure 41:
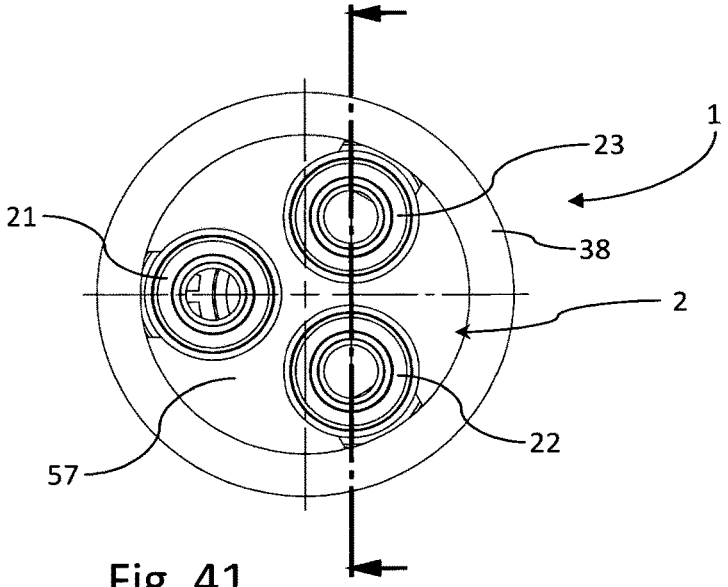
FIG. 41 shows a top view of the inlet side of the basic body of the outlet piece in a further exemplary embodiment.
Figure 42:
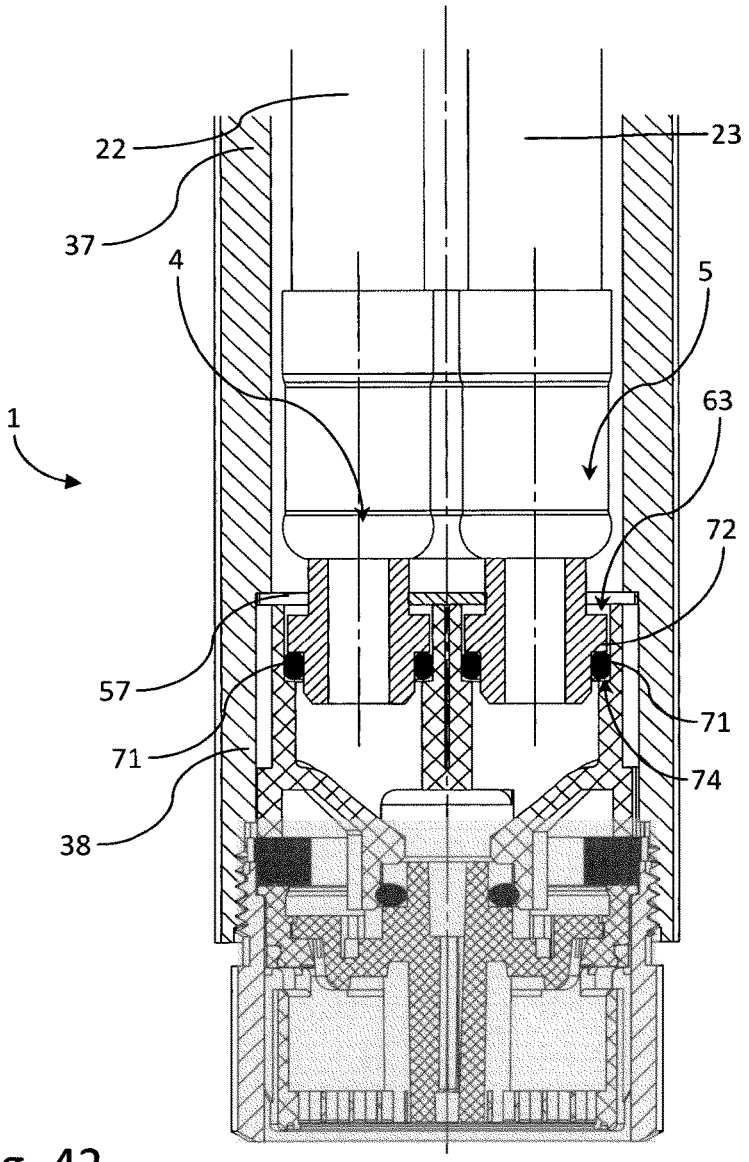
FIG. 42 shows a sectional illustration along the intersecting plane according to FIG. 41.

FIGS. 41 and 42 show a further sanitary outlet piece 1 according to the invention. Components and functional units which are structurally and/or functionally similar or identical to the preceding exemplary embodiments are denoted by the same reference signs and are not described separately. The statements with regard to FIGS. 1 to 40 therefore apply correspondingly to FIGS. 41 and 42.

The exemplary embodiment according to FIGS. 41 and 42 differs, for example, from the exemplary embodiment according to FIG. 28 in that only one shoulder-shaped holding edge 63 is formed in each case instead of the holding groove 61 on the hoses 22, 23—and analogously on the hose 21—said holding edge engaging over the holding plate 57 on one side in such a manner that an inadvertent slipping or pulling of the hose 21, 22, 23 out of the respective hose receptacle 3, 4, 5 is prevented.

The illustrations according to FIGS. 23 to 42 in each case show hose receptacles 3, 4, 5 with corresponding opening diameters 18. In the case of further exemplary embodiments, different opening diameters 17, 18 can also be formed—for example analogously to FIG. 2.

In the case of the sanitary outlet piece 1, it is proposed, on an inlet side 2, to form at least two hose connection points 3, 4, 5 which are offset laterally with respect to one another and are guided separately from one another in the sanitary outlet piece 1 from the inlet side 2 to an outlet side 6 of the sanitary outlet piece 1.

LIST OF REFERENCE SIGNS

1 Sanitary outlet piece
2 Inlet side
3, 4, 5 Hose connection point
6 Outlet point
7, 8 End
9 Insertion direction
10 Outer wall
11, 12, 13 Water outlet
14, 15, 16 Water duct
17, 18 Opening diameter
19 Internal thread
20 Connecting piece
21, 22, 23 Hose
24 Crimp sleeve
25 Outlet opening
26 Distribution chamber
27 Outlet opening
28 Distribution chamber
29 Groove base
30 Annular groove
31 Groove base
32 Annular groove
33 Basic body
34 First part
35 Second part
36 Connecting point
37 Sanitary fitting
38 Fitting outlet
39 Tubular receptacle
40 Stop
41 Screw sleeve
42 Outlet element
43 Metering and/or mixing device
44 Hot water inlet
45 Cold water inlet
46 Outlet for mixed water
47 Two-way lever
48 Outlet for hot water
49 Outlet for cold water
50, 51 Housing edge
52 Insertion plate
53 Holding projection
54 Fastening means
55 Sealing ring
56 Outlet nozzle
57 Holding plate
58, 59, 60 Recess
61 Holding groove
62 Holding stop
63 Holding edge
64 Jet former cartridge
65 Connecting piece
66 Supporting edge
67 Connecting-piece receptacle
68 Rectifying element
69 Inner wall
70 Leakage outlet
71 Sealing ring
72 Shoulder
73 Groove
74 Further shoulders

The invention claimed is:

1. A sanitary outlet piece (1) for inserting into a fitting outlet, the sanitary outlet piece comprising a basic body (33) configured for insertion in a discharge opening of a sanitary fitting, the basic body including an inlet side (2), an outlet side (6) and more than two hose connection points (3, 4, 5) that are formed spaced apart from one another on the inlet side (2) and are each guided to the outlet side (6), a holding plate (57) having at least three recesses (58, 59, 60) corresponding to the hose connection points (3, 4, 5), one hose (21, 22, 23) being insertable into a corresponding one of the hose connection points by an insertion movement oriented transversely with respect to a longitudinal direction of the respective hose (21, 22, 23), resulting in a plug-in system arrangement of the hoses which are connectable to the hose connection points (3, 4, 5) without being screwed in, wherein the hose connection points (3, 4, 5) are guided to the outlet side (6) at a fitting discharge end that discharges to atmosphere separately from one another.

2. The sanitary outlet piece as claimed in claim 1, further comprising at least one housing edge (50, 51) arranged between the inlet side (2) and the outlet side (6).

3. The sanitary outlet piece as claimed in claim 1, wherein the inlet side (2) and the outlet side (6) are arranged spaced apart from each other.

4. The sanitary outlet piece (1) as claimed in claim 1, wherein the inlet side (2) and the outlet side (6) enclose an angle.

5. The sanitary outlet piece as claimed in claim 1, wherein the hose connection points (3, 4, 5) and the outlet side (6) are formed at mutually opposite ends (7, 8) of the outlet piece (1).

6. The sanitary outlet piece as claimed in claim 5, further comprising outer wall (10) formed between the opposite ends (7, 8) of the outlet piece (1).

7. The sanitary outlet piece as claimed in claim 6, wherein individual or all of the hose connection points (3, 4, 5) are formed on the outer wall (10).

8. A sanitary outlet piece (1) for inserting into a fitting outlet, the sanitary outlet piece comprising a basic body (33) configured for insertion in a discharge opening of a sanitary fitting, the basic body including an inlet side (2), an outlet side (6) and more than two hose connection points (3, 4, 5) that are formed spaced apart from one another on the inlet side (2) and are each guided to the outlet side (6), a holding plate (57) having at least three recesses (58, 59, 60) corresponding to the hose connection points (3, 4, 5), one hose (21, 22, 23) being insertable into a corresponding one of the hose connection points by an insertion movement oriented transversely with respect to a longitudinal direction of the respective hose (21, 22, 23), resulting in a plug-in system arrangement of the hoses which are connectable to the hose connection points (3, 4, 5) without being screwed in, wherein at least one of the hose connection points (3, 4, 5) is guided to the outlet side (6) at a fitting discharge end to atmosphere in at least one of a valve-free or junction-free manner.

9. The sanitary outlet piece as claimed in claim 1, wherein water outlets (11, 12, 13) which are separated from one another are formed on the outlet side (6) and are each connected to one of the hose connection points (3, 4, 5).

10. The sanitary outlet piece as claimed in claim 1, wherein at least one of the hose connection points (3, 4, 5) has a different opening diameter (17, 18) than remaining ones of the hose connection points (3, 4, 5).

11. A sanitary outlet piece (1) for inserting into a fitting outlet, the sanitary outlet piece comprising a basic body (33) with an inlet side (2), an outlet side (6) and more than two hose connection points (3, 4, 5) that are formed spaced apart from one another on the inlet side (2) and are each guided to the outlet side (6), a holding plate (57) having at least three recesses (58, 59, 60) corresponding to the hose connection points (3, 4, 5), one hose (21, 22, 23) being insertable into a corresponding one of the hose connection points by an insertion movement oriented transversely with respect to a longitudinal direction of the respective hose (21, 22, 23), resulting in a plug-in system arrangement of the hoses which are connectable to the hose connection points (3, 4, 5) without being screwed in, and an internal thread (19) into which a connecting piece (20) of the outlet piece (1) is screwable, insertable or fixable formed at least at one of the hose connection points (3, 4, 5).

12. The sanitary outlet piece as claimed in claim 1, wherein the holding plate (57) is adapted to be engaged over on both sides by a holding groove (61) formed on the hose (21, 22, 23) or on one side by a holding edge (63) formed on the hose (21, 22, 23).

13. The sanitary outlet piece as claimed in claim 12, further comprising a holding stop (62) formed on an outlet element (42) fitted onto the basic body (33) on the outflow side, at which holding stop the basic body (33) is pressable against the holding plate (57), which is supported from outside.

14. The sanitary outlet piece as claimed in claim 13, wherein the basic body (33) is pressable with a screw sleeve (41) against a holding plate (57), which is supported from the outside.

15. The sanitary outlet piece as claimed in claim 14, wherein the basic body (33) is pressable via the holding stop (62) against the outlet element (42) which is fitted on the basic body (33) on the outflow side.

16. The sanitary outlet piece as claimed in claim 15, wherein the screw sleeve (41) has a thread for screwing to a mating thread provided on a fitting outlet (38).

17. The sanitary outlet piece as claimed in claim 1, wherein at least one of the hose connection points (3, 4, 5) is guided via a distribution chamber (26, 28) to a plurality of outlet openings (25, 27) of the outlet piece (1).

18. The sanitary outlet piece as claimed in claim 17, wherein the outlet openings (25, 27) are formed in at least one groove base (29, 31) of an outwardly open annular groove (30, 32), and the hose connection points (3, 4, 5) are formed on a first part (34) of the basic body (33) and the outlet side (6) is formed on a second part (35) of the basic body (33).

19. The sanitary outlet piece as claimed in claim 18, wherein the first part (34) and the second part (35) are connected to each other in at least one of an integrally bonded, form-fitting, or force-fitting manner.

20. The sanitary outlet piece as claimed in claim 1, further comprising a jet regulator or a jet former connected downstream of at least one of the hose connection points (3, 4, 5).

21. The sanitary outlet piece as claimed in claim 1, wherein at least two of the at least three hose connection points (3, 4, 5) are guided separately to a common outlet nozzle (56).

22. A sanitary fitting (37), comprising: a fitting outlet, a sanitary outlet piece (1) as claimed in claim 1 inserted into the fitting outlet (38), and at least one of said hose connection points (3, 4, 5) is connected to an output of at least one of a metering or mixing device (43).

23. The sanitary fitting (37) as claimed in claim 22, wherein the outlet piece (1) is held by an outlet element (42).

24. The sanitary fitting as claimed in claim 23, wherein the outlet piece (1) is an outlet sieve or outlet rectifier or a jet regulator or jet former.

25. The sanitary fitting as claimed in claim 22, further comprising a respective hose (21, 22, 23) which has a holding groove (61) arranged on each of said hose connecting points (3, 4, 5), and the holding plate (57) includes a recess (58, 59, 60) that engages laterally in the holding groove (61) in order to fix the hose (21, 22, 23) in a longitudinal direction thereof on the hose connection point (3, 4, 5).

26. The sanitary fitting as claimed in claim 22, wherein the inlet side (2) and the outlet side (6) of the outlet piece (1) are formed on a single-piece basic body (33), a jet former cartridge (64) connected downstream of the basic body (33) and lies with a supporting edge (66) against the basic body (33), and a connecting piece (65) of the jet former cartridge (64) projects over the supporting edge (66) and engages in a corresponding connecting-piece receptacle (67) on the basic body (33).

27. The sanitary fitting as claimed in claim 26, wherein the connecting piece (65) of the jet former cartridge (64) engages in a sealing manner in the corresponding connecting-piece receptacle (67) on the basic body (33).

28. A sanitary outlet piece (1) for inserting into a fitting outlet, the sanitary outlet piece comprising a basic body (33) with an inlet side (2), an outlet side (6) and more than two hose connection points (3, 4, 5) that are formed spaced apart from one another on the inlet side (2) and are each guided to the outlet side (6), a holding plate (57) having at least three recesses (58, 59, 60) corresponding to the hose connection points (3, 4, 5), one hose (21, 22, 23) being insertable into a corresponding one of the hose connection points by an insertion movement oriented transversely with respect to a longitudinal direction of the respective hose (21, 22, 23), resulting in a plug-in system arrangement of the hoses which are connectable to the hose connection points (3, 4, 5) without being screwed in, at least one of the hose connection points (3, 4, 5) is guided via a distribution chamber (26, 28) to a plurality of outlet openings (25, 27) of the outlet piece (1), and at least two of the distribution chambers (26, 28) are connected to one said hose connection point (3, 4, 5) each and are each guided to one of the plurality of outlet openings (25, 27).

29. The sanitary outlet piece as claimed in claim 28, further comprising at least two concentric arrangements of the outlet openings (25, 27) formed on the outlet side (6), each said arrangement of the outlet openings is connected to a hose connection point (3, 4, 5).

30. A sanitary outlet piece (1) for inserting into a fitting outlet, the sanitary outlet piece comprising a basic body (33) with an inlet side (2), an outlet side (6) and more than two hose connection points (3, 4, 5) that are formed spaced apart from one another on the inlet side (2) and are each guided to the outlet side (6), a holding plate (57) having at least three recesses (58, 59, 60) corresponding to the hose connection points (3, 4, 5), one hose (21, 22, 23) being insertable into a corresponding one of the hose connection points by an insertion movement oriented transversely with respect to a longitudinal direction of the respective hose (21, 22, 23), resulting in a plug-in system arrangement of the hoses which are connectable to the hose connection points (3, 4, 5) without being screwed in, at least one of the hose connection points (3, 4, 5) is guided via a distribution chamber (26, 28) to a plurality of outlet openings (25, 27) of the outlet piece (1), and the distribution chamber (26, 28) is formed at a connecting point (36) between a first part (34) and a second part (35) of the basic body (33).

31. A sanitary outlet piece (1) for inserting into a fitting outlet, the sanitary outlet piece comprising a basic body (33) with an inlet side (2), an outlet side (6) and more than two hose connection points (3, 4, 5) that are formed spaced apart from one another on the inlet side (2) and are each guided to the outlet side (6), a holding plate (57) having at least three recesses (58, 59, 60) corresponding to the hose connection points (3, 4, 5), one hose (21, 22, 23) being insertable into a corresponding one of the hose connection points by an insertion movement oriented transversely with respect to a longitudinal direction of the respective hose (21, 22, 23), resulting in a plug-in system arrangement of the hoses which are connectable to the hose connection points (3, 4, 5) without being screwed in, and at least one leakage outlet (70) formed on the basic body (33), said leakage outlet connecting a space adjacent to the more than two hose connection points (3, 4, 5) to an external environment.

* * * * *